United States Patent [19]

Tsutsumi et al.

[11] Patent Number: 4,961,364

[45] Date of Patent: Oct. 9, 1990

[54] MUSICAL TONE GENERATING APPARATUS FOR SYNTHESIZING MUSICAL TONE SIGNAL BY COMBINING COMPONENT WAVE SIGNALS

[75] Inventors: Kenichi Tsutsumi; Jun Yoshino, both of Tokyo, Japan

[73] Assignee: Casio Computer Co., Ltd., Tokyo, Japan

[21] Appl. No.: 158,562

[22] Filed: Feb. 22, 1988

[30] Foreign Application Priority Data

| | | | |
|---|---|---|---|
| Feb. 25, 1987 | [JP] | Japan | 62-40455 |
| Feb. 25, 1987 | [JP] | Japan | 62-25501[U] |
| Feb. 25, 1987 | [JP] | Japan | 62-25503[U] |
| Feb. 25, 1987 | [JP] | Japan | 62-25504[U] |
| Feb. 25, 1987 | [JP] | Japan | 62-25505[U] |

[51] Int. Cl.[5] ..... G10H 7/00; G10H 1/02; G10H 1/06

[52] U.S. Cl. ..... 84/627; 84/602; 84/615; 84/622; 84/626

[58] Field of Search ..... 84/1.13, 1.11, 1.12, 84/1.20, 1.21, 1.22, 1.23, 1.19, 1.26, 1.27, 1.01, 602, 604, 607, 615, 622–627, 632

[56] References Cited

U.S. PATENT DOCUMENTS

| | | | |
|---|---|---|---|
| 2,989,885 | 6/1961 | Pearson | 84/1.28 X |
| 3,913,442 | 10/1975 | Deutsch | 84/DIG. 5 |
| 4,077,294 | 3/1978 | Hiyoshi et al. | 84/1.23 |
| 4,083,285 | 4/1978 | Chibana . | |
| 4,149,440 | 4/1979 | Deforeit . | |
| 4,215,617 | 8/1980 | Moorer . | |
| 4,401,975 | 8/1983 | Ferguson et al. | 84/1.26 X |
| 4,471,681 | 9/1984 | Nishimoto . | |
| 4,502,361 | 3/1985 | Viitanen et al. | 84/1.26 |
| 4,696,216 | 9/1987 | Asahi et al. | 84/1.26 |
| 4,833,963 | 5/1989 | Hayden | 84/623 |

*Primary Examiner*—A. T. Grimley
*Assistant Examiner*—Matthew S. Smith
*Attorney, Agent, or Firm*—Frishauf, Holtz, Goodman & Woodward

[57] ABSTRACT

A global envelope is input by a user and stored in a global envelope memory. At the respective envelope-controlled sine wave generators are generated envelope functions of the respective orders by modifying the input global envelope. The envelopes of component wave signals of a plurality of orders are independently controlled by the envelope functions having the respective orders in the generators, and a musical tone signal is synthesized by combining the envelope-controlled component wave signals.

18 Claims, 14 Drawing Sheets

| HARMONIC DATA | CODE CONVERSION |
|---|---|
| 0 | NO CONVERSION |
| 1 | CONVERSION INTO KEY CODE CORRESPONDING TO SECOND HARMONIC |
| 2 | CONVERSION INTO KEY CODE CORRESPONDING TO THIRD HARMONIC |
| --------- | --------- |
| 31 | CONVERSION INTO KEY CODE CORRESPONDING TO 32 ND. HARMONIC |

FIG. 3

| STEP | RATE DATA | LEVEL DATA |
|---|---|---|
| 1 | 20 | 100 |
| 2 | 10 | 50 |
| 3 | 5 | 70 |
| 4 | 10 | 00 |
| | 0 ≦ RATE ≦ 100 | 0 ≦ LEVEL ≦ 100 |

MUSICAL TONE GENERATING APPARATUS FOR SYNTHESIZING MUSICAL TONE SIGNAL BY COMBINING COMPONENT WAVE SIGNALS

BACKGROUND OF THE INVENTION

1. Field of the Invention

The present invention relates to a musical tone generating apparatus and, more particularly, to a musical tone generating apparatus of a type such as a sine wave synthesizing type for synthesizing a musical tone signal, by combining envelope-controlled component wave signals of plurality of orders from a component wave generating means.

2. Description of the Related Art

In a known conventional musical tone generating apparatus, envelopes respectively corresponding to a plurality of sine waves as frequency components of the musical tone are independently controlled to change tone colors as a function of time.

A musical tone generating apparatus of this type is described in e.g., U.S. Pat. No. 4,083,285.

In a conventional musical tone generating apparatus of this type, if a user can arbitrarily manipulate envelopes of sine waves, musical performance effects can be naturally improved.

However, with the above apparatus, the user must spend long time setting envelopes in proportion to an increase in envelope flexibility or versatility. Overloading on the user can be easily expected.

SUMMARY OF THE INVENTION

It is, therefore, an object of the present invention to provide a musical tone generating apparatus capable of producing envelope functions independently of respective component wave signals in response to simple input operations.

In order to achieve the above object of the present invention, there is provided a musical tone generating apparatus of a type for synthesizing a musical tone signal by controlling envelopes of a plurality of component wave signals of orders from component wave generating means in accordance with envelope functions of corresponding orders, comprising:

common envelope setting means for supplying a single common envelope function to the plurality of component wave signals of the plurality of orders; and envelope modifying means for modifying the common envelope function supplied from the common envelope setting means into values of the plurality of orders, thereby generating the envelope functions for controlling the envelopes of the component wave signals.

In addition, to achieve a variety of tone colors, there is provided a musical tone generating apparatus of a type for synthesizing a musical tone signal such that envelopes are provided to a plurality of component wave signals by using independent envelope functions, comprising:

first generating means for generating component wave signals of a plurality of orders constituting a first group;

second generating means for generating component wave signals of a plurality of orders constituting a second group;

global envelope setting means for supplying at least one type of global envelope function;

first envelope modifying means for modifying the global envelope function from the global envelope setting means, in accordance with its order, thereby generating first envelope functions of the respective orders; and second envelope modifying means for modifying the global envelope function from the global envelope setting means in accordance with its order, thereby generating second envelope functions of the respective orders, wherein the component wave signals belonging to the first group are controlled by the first envelope functions of the corresponding orders from the first envelope modifying means, the component wave signals belonging to the second group are controlled by the second envelope functions of the corresponding orders from the second envelope modifying means, and the first envelope functions generated by the first envelope modifying means and the second envelope functions generated by the second envelope modifying means are independent of each other regardless of the orders.

According to the present invention, the user need not produce individual envelope functions for the component wave signals of a plurality of orders in order to obtain musical tones. For example, at a data input device such as a keyboard, the user selects only one envelope function to obtain a variety of tone colors because a plurality of envelope functions are generated on the basis of one envelope function (i.e., a single common or global envelope function) generated by an envelope modifying means. An envelope function for controlling an envelope of a component wave signal of a given order is obtained by modifying the common envelope function in accordance with a value of a corresponding order of the component wave signal.

If a value of the common envelope function is given as w and a value of the order is given as x, the envelope modifying means performs modification represented by the following function:

$$G(x,w)$$

The value of function G(x,w) is determined by parameter x and parameter w. The modified value of function G(x,w) is a value for the xth-order envelope function. That is, it is a value of the envelope function for controlling the envelope of the xth-order component wave signal. In other words, function G(x,w) provides a modification characteristic for modifying the common envelope function into the envelope functions of the respective orders.

In one example, if order value x and value w of the single common envelope function are given, function G(x,w) can be calculated in accordance with arithmetical and logical operations. In this case, the envelope modifying means can be basically realized by a means for executing appropriate logical and/or arithmetical algorithms.

In another example, modification characteristic function G(x,w) is solely determined if order value x and the value w of the common envelope function are given. However, this function cannot be solved by arithmetic and logical operations or cannot be calculated for at least a given combination of x and w. In this case, the envelope modifying means can be constituted by using a modification table (e.g., a memory such as a ROM) in the range where calculations cannot be performed. The modification table can also be used in the first example. A suitable construction can be determined in consideration of a processing speed, an operation volume, and a required memory capacity.

As should be clear from the above, the term "modifying" as used in this specification and claims, includes modifications performed by, for example, arithmetic operations such as addition, subtraction, multiplication and division, modification performed by a logical operation, and table modification performed by accessing a table stored in, for example, semiconductor memory such as a ROM or a RAM.

In a simple example, a monotonous function (e.g., monotonous for $x-w=u$, $x/w=u$, $x \cdot w=u$, and $x+w=u$, or monotonous for all parameters u as a combination of the above arithmetic operations) can be used as modification characteristic function G(x,w). In this case, logical operations (e.g., comparison, AND, and OR) need not be performed. Only the arithmetical calculations can be performed.

In a more complicated example, modification characteristic function G(x,w) can be defined as a function in which the characteristics are changed in ranges of values of parameter u if parameter u is calculated by arithmetical operations using parameter x of the order and parameter w of the envelope function. In this case, an appropriate function is selected in accordance with the value of parameter u. For example, if $u>0$, then monotonous function $G_1(u)$ serves as a modification characteristic function. If $u \leqq 0$, another monotonous function $G_2(u)$ serves as a modification characteristic function. In this case, logical operations are added to the arithmetical operations.

In either case, the envelope modifying means produces envelopes of respective orders from the common envelope function. As a result, the user is free from production of respective envelope functions for the corresponding component waves and can easily produce musical tones.

The common envelope function input to the envelope modifying means can be expressed in various forms. In a simplest example in digital techniques, an envelope function can be given as a waveform data format (i.e., a sequence of digital data representing the instantaneous values of the envelope levels). In many examples, the envelope functions can be represented by compressed data (control information). For example, an envelope function of a polygonal type is expressed as a set of position data of polygonal points (e.g., this function is expressed by several step rate data and several step level data). Not many envelope input devices are available to input envelope functions in the form of waveform data. For example, when an envelope waveform is drawn on an input device such as a tablet, A/D-converted data (data prior to data compression) is expressed in the form of waveform data. The form of the input device for inputting the common envelope function is not important to the present invention.

The form of modification processing varies in the envelope modifying means in accordance with the form of expression of the input common envelope function. For example, in a given arrangement, the envelope modifying means modifies the common envelope function given in the form of digital waveform data into envelope functions of the respective orders represented in the same form as the common envelope-function. That is, each digital value of the common envelope function is modified into the corresponding digital value of an envelope functions of each order. The modified envelope functions of the respective orders which are expressed in the form of waveform data can be directly inparted to a component wave signal in the form of waveform data. Alternatively, the above envelope functions of the respective orders may be decoded into the envelope function in the form of waveform data upon generation of a musical tone signal after the envelope functions of the respective orders are compressed in the form of control information. In another arrangement, the envelope modifying means modifies the common envelope function given in the form of control information into the envelope functions of the respective orders in the same form as the common envelope function. In this case, in a simple example, the values of the control information (e.g., values of rate data and level data for each step, or coordinates of each polygonal point) are converted in accordance with modification characteristic function G(x,w), thereby obtaining the envelope functions of the respective orders. In a more complicated example, the modification characteristic function is also applied to points on a polygonal line (these points can be easily calculated by arithmetical operations because the common envelope function is defined by control information) in addition to polygonal points, thereby obtaining points defining the envelope functions of the respective orders.

The envelope function of each order modified by the envelope modifying means is finally used to control the envelope of the component wave signal of the order corresponding to the envelope function. This envelope control can be performed by a digital multiplier, an analog multiplier, or a device for performing other functionally or equivalently performing a multiplication.

According to the present invention, the component wave signal is not limited to the sine wave signal but can be extended to any waveform signal having a frequency or a frequency spectrum corresponding to the order. For example, a rectangular wave (e.g., a rectangular wave obtained by the Walsh function) can be used as a component wave signal.

According to the specific form of the present invention, independent envelopes can be given in units of groups of component waves, and musical tones with a variety of tone colors can be obtained.

A means for establishing an independent relationship between an envelope function for a component wave belonging to a given group (e.g., the first group) and that belonging to another group (e.g., the second group) can be arranged in several specific forms. In a given example, a global envelope setting means provides different global envelope functions in units of groups. In this case, the user produces different envelopes in units of component wave groups. The envelope modifying means for the first group generates envelope functions of the respective orders on the basis of the first global envelope function. The envelope modifying means for the second group produces envelope functions of the respective orders on the basis of the second global envelope function. With the above arrangement, independency of the envelopes of the different groups can be established due to the following reason.

Assume the modification logical algorithm used in the first and second envelope modifying means is the same and is given as Fx(W) where x is the order and W is the global envelope function. In other words, Fx(W)

is the xth-order envelope function. The envelope modifying means modifies the global envelope function in accordance with its orders. Condition $Fx(W) \neq Fy(W)$ is established between envelope functions Fx(W) and Fy(W) having different orders x and y. However, if envelope functions have the same order, $Fx(W)=Fx(W)$. In other words, functions Fx(W) and Fy(W) depend on the orders (if identical global envelope functions are assumed).

In the above case, the first global envelope function W1(t) and the second envelope function W2(t) are independently determined by the user and are independent functions. Functions obtained by modifying independent functions on the basis of the same modification logical algorithm are independent. If the first envelope modifying means produces xth-order envelope function Fx(W1(t)) and the second envelope modifying means produces xth-order envelope function Fx(W2(t)), condition $Fx(W1(t)) \neq Fx(W2(t))$ is established. Since functions W1(t) and W2(t) are independent, envelope function group {Fx(W1(t))} for controlling the component waves of the first group and envelope function group {Fx(W2(t))} for controlling the component waves of the second group are independent.

In another arrangement, assume that modification logical algorithm Fx(W) of the first envelope modifying means and modification logical algorithm Gx(W) of the second envelope modifying means are independent or different. In this case, either envelope modifying means can receive the same global envelope function. In other words, the global envelope setting means can provide only one global envelope function.

In the same manner as described above, the envelope function group {Fx(W)} generated by the first envelope modifying means to control the component waves of the first group and envelope function group {Gx(W)} generated by the second envelope modifying means to control the component waves of the second group are independent of each other.

In still another arrangement, a means can be used to modify a single global envelope function set by the user into global envelope functions which are independent between the groups. The global envelope function of each group is supplied to the corresponding envelope modifying means. For example, global envelope function G(W) for the first group is supplied to the first envelope modifying means and global envelope function H(W) for the second group is supplied to the second envelope modifying means. With this arrangement, either envelope modifying means (i.e., a means for modifying the global envelope group into envelope functions of the respective orders) can employ the same modification logical algorithm.

BRIEF DESCRIPTION OF THE DRAWINGS

FIG. 3 is a table showing a key code conversion logic algorithm in a key code converter in FIG. 2;

DETAILED DESCRIPTION OF THE PREFERRED EMBODIMENTS

A few preferred embodiments of the present invention will be described in detail hereinafter. These embodiments exemplify sine wave synthesis type musical tone generating apparatuses.

Figure 1:
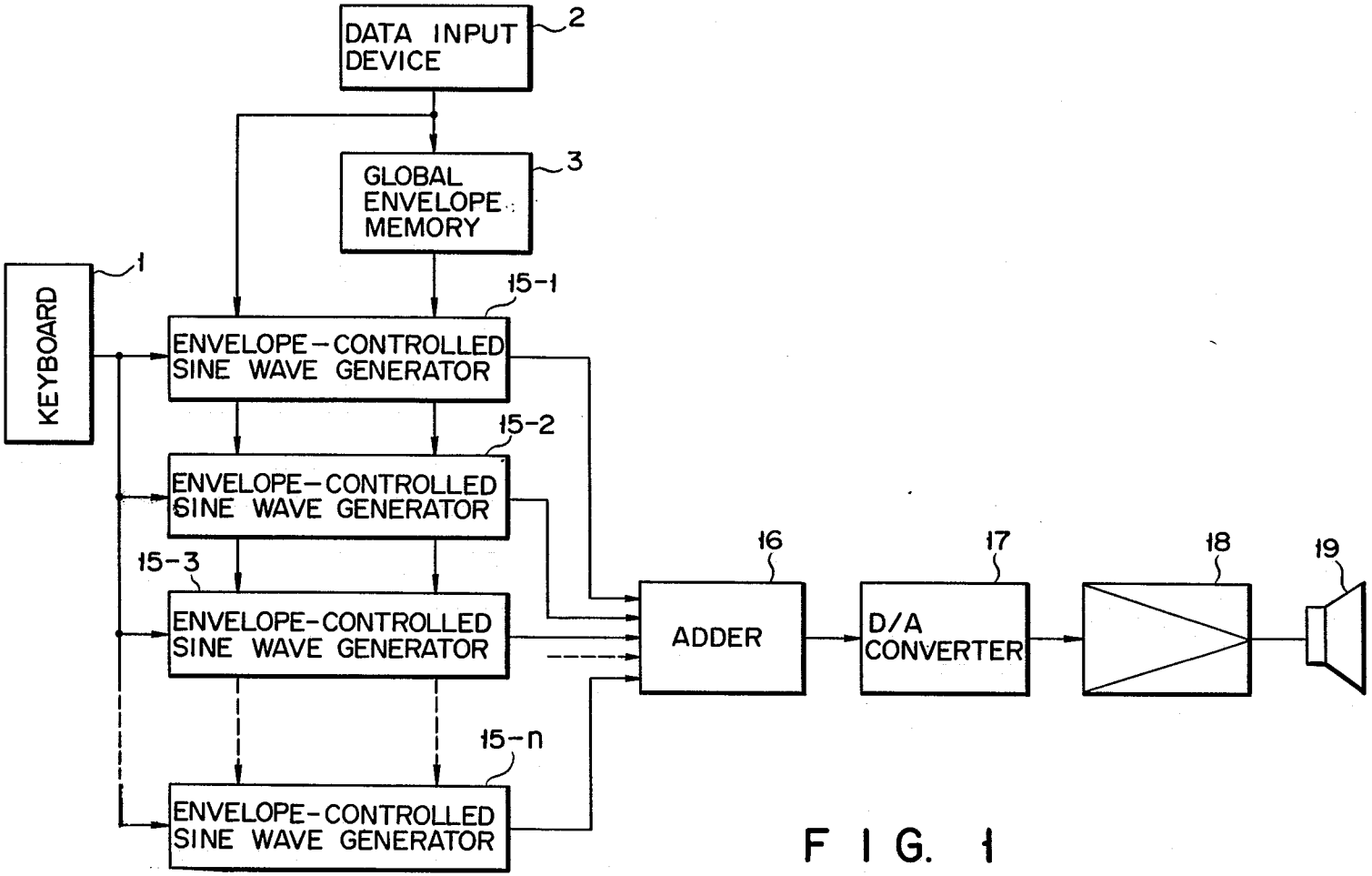
FIG. 1 a block diagram showing the overall circuit arrangement according to an embodiment of the present invention.

The first embodiment will be described below. FIG. 1 shows the overall circuit arrangement of a sine wave synthesis type musical tone generating apparatus. Referring to FIG. 1, n envelope-controlled sine wave generators 15-l to 15-n are connected to keyboard 1 serving as a performance input device, data input device 2 for inputting various data, and global envelope memory (common envelope memory) 3. Envelope-controlled sine wave generators 15-l to 15-n are arranged to generate sine waves having independent frequencies on the basis of harmonic data set by a user at data input device 2. Global envelope memory 3 comprises a RAM and stores global envelope function data set at data input device 2. The global envelope is modified by the circuit constructed in the sine wave generators 15-l to 15-n into envelope function data depending on their assigned frequencies (i.e., orders). The sine waves generated in generators 15-l to 15-n are envelope-controlled by the modified envelope data.

In this embodiment, when the user sets one global envelope function, n independent envelope functions can be obtained for the preset global envelope function. The user need not set n envelopes for the respective sine waves, thereby reducing envelope producing labor.

Envelope-controlled sine wave data from envelope-controlled sine wave generators 15-l to 15-n are added by adder 16, and a sum signal (musical tone signal) is converted into an analog signal by D/A converter 17. The analog signal is produced as a tone through amplifier 18 and loudspeaker 19.

Figure 2:
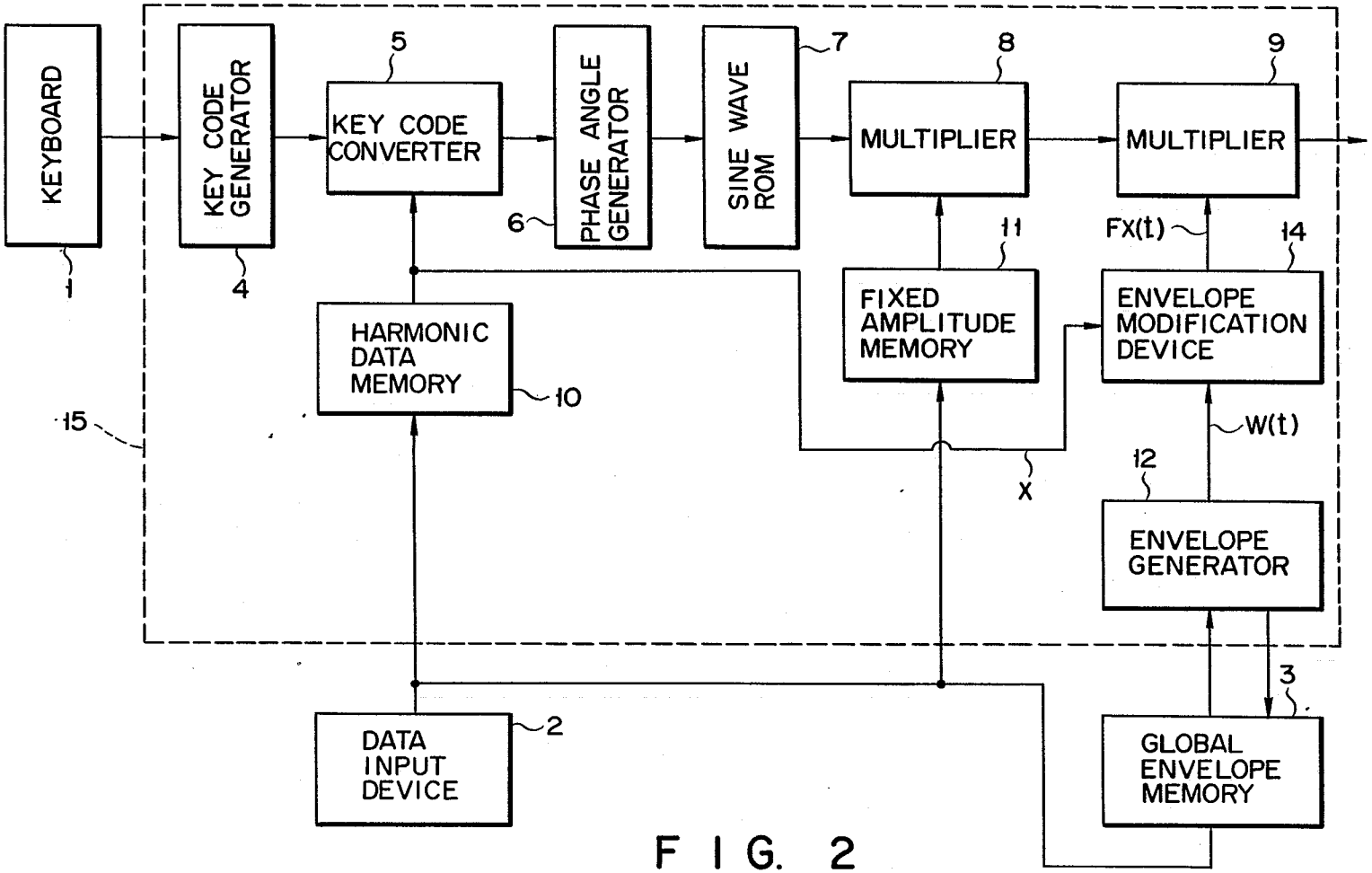
FIG. 2 is a block diagram showing a detailed circuit arrangement of an envelope-controlled sine wave generator in the circuit shown in FIG. 1.

The detailed arrangement of each envelope-controlled sine wave generator is shown in FIG. 2. The arrangement surrounded by the dotted line and denoted by reference numeral 15 represents one of envelope-controlled sine wave generators 15-l to 15-n. Referring to FIG. 2, key code generator 4 generates a key code corresponding to the depressed key at keyboard 1. Key code converter 5 converts the generated key code in accordance with a value in harmonic data memory 10. Memory 10 can store harmonic data (harmonic orders) of 0 to 31 which can be set by the user at data input device 2. Key code converter 5 converts the key code using the stored harmonic data in accordance with a method shown in FIG. 3. For example, if harmonic data represents 1, the key code is converted into another key code representing a second harmonic which represents a tone higher by one octave than the original tone. Phase angle generator 6 comprises a frequency data ROM and an accumulator and causes the frequency data ROM to convert the key code from key code converter 5 into frequency data, and the accumulator to accumulate the frequency data so as to generate a phase angle corresponding to the key code, thereby reading out sine wave data from sine wave ROM 7. An output from sine wave ROM 7 is a sine wave signal having a frequency corresponding to the order of a harmonic set in harmonic data memory 10. In this embodiment, the key code is converted in accordance with the harmonic data. However, frequency data may be converted into frequency data corresponding to the harmonic in accordance with bit shifting or the like. Alternatively, the value of the phase angle output from phase angle generator 6 may be converted to obtain a phase angle representing the corresponding order. In this manner, various circuit modifications may be proposed.

Fixed amplitude memory 11 comprises a RAM for storing data for controlling (scaling) the amplitude of the sine wave signal from sine wave ROM 7 regardless of time changes. Scaling data can be input by the user at data input device 2. Scaling data stored in fixed amplitude memory 11 represent independent values for envelope-controlled sine wave generators 15-l to 15-n. Therefore, when the sine wave data from sine wave ROM 7 is multiplied by each multiplier 8 with the data read out from fixed amplitude memory 11, relative amplitudes of n sine wave signals can be independently controlled.

The amplitude-controlled sine wave signal from multiplier 8 is multiplied with an envelope signal output from envelope modification device 14 (to be described in detail later). Therefore, amplitude control as a function of time can be performed, and the product is output from envelope sine wave generator 15.

Figures 4, 5:
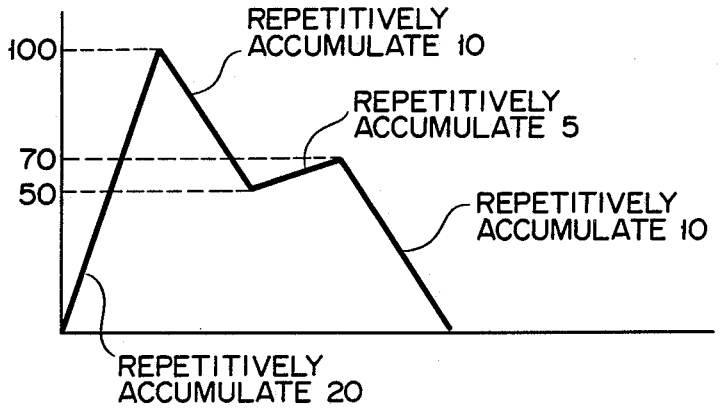
FIG. 4 a map showing a format of envelope data stored in a global envelope memory shown in FIGS. 1 and 2.
FIG. 5 is a waveform chart showing an envelope generated by an envelope generator in accordance with envelope data shown in FIG. 4.

As described above, global envelope memory 3 stores common global envelope function data for n envelope-controlled sine wave generators 15-l to 15-n. The global envelope function in global envelope memory 3 can be expressed by 4-step rate data and 4-step level data (FIG. 4). The global envelope function in this form is modified into the form of waveform data by envelope generator 12 (FIG. 5). More specifically, envelope generator 12 comprises an accumulator and a comparator and receives step-1 rate data of step-1 level data from global envelope memory 3. The rate data is repetitively accumulated. If the accumulation result reaches the level data, envelope generator 12 receives step-2 rate data and step-2 level data from global envelope memory 3. The above operations are repeated to obtain waveform data of the global envelope.

Envelope modification device 14 modifies the waveform data of the common global envelope function generated by envelope generator 12 into waveform data of envelope functions of the respective orders in accordance with harmonic data (order) from harmonic data memory 10. For example, if the harmonic data from harmonic data memory 10 in envelope-controlled sine wave generator 15 is 1 (i.e., this value represents a second harmonic), the first-order envelope waveform data is generated by envelope modification device 14. The first-order envelope waveform data is multiplied with a sine wave signal having a frequency of the second harmonic, thereby controlling the envelope.

The arbitrary modification characteristic of envelope modification device 14 can be provided in principle. In practice, the modification characteristic for a resonance effect will be described first.

Figure 6:
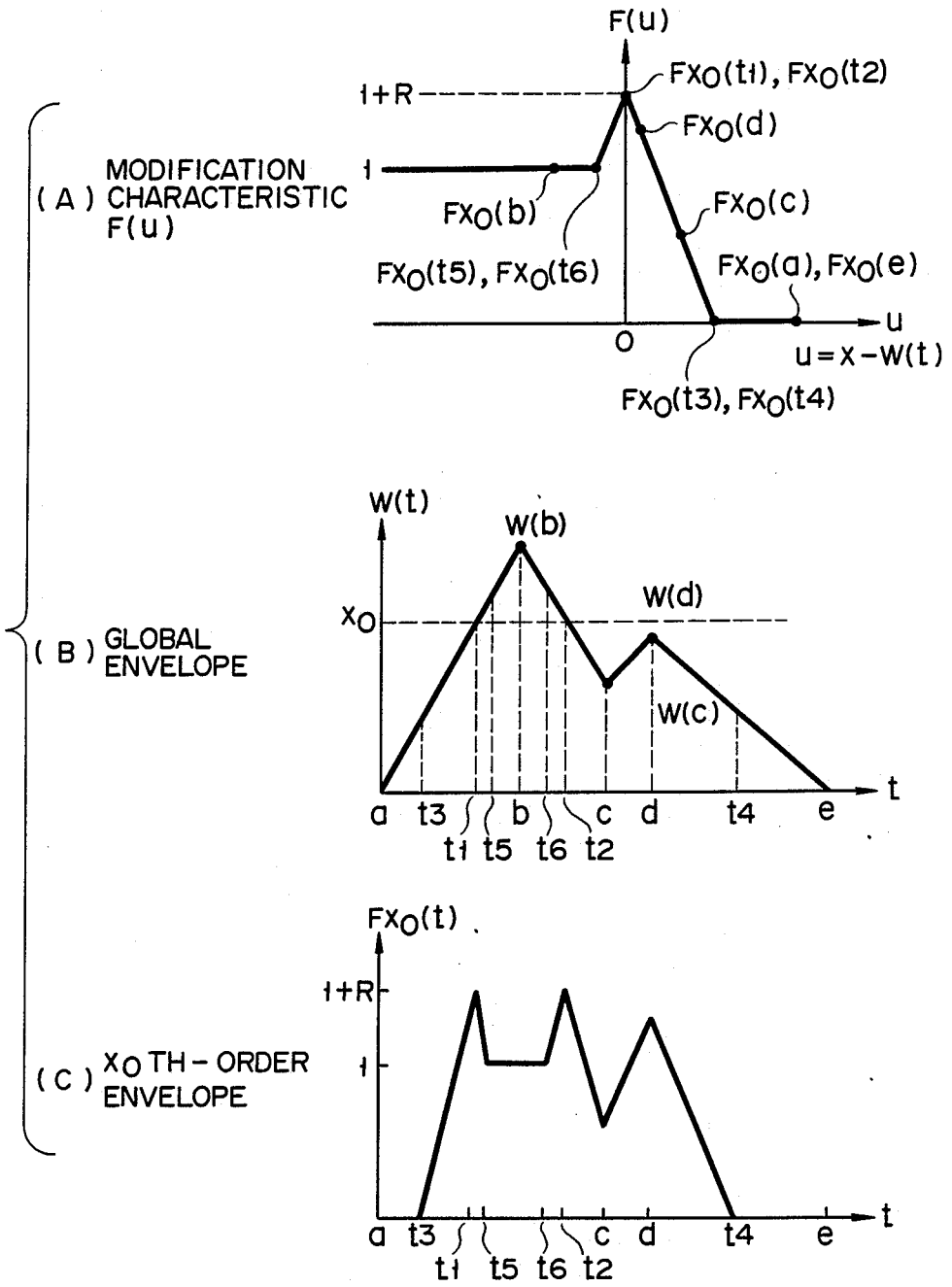
FIGS. 6(A) to 6(C) are waveform charts showing envelope modifications for obtaining a low-pass filter type resonance effect in the envelope modification device in FIG. 2.
Figure 7:
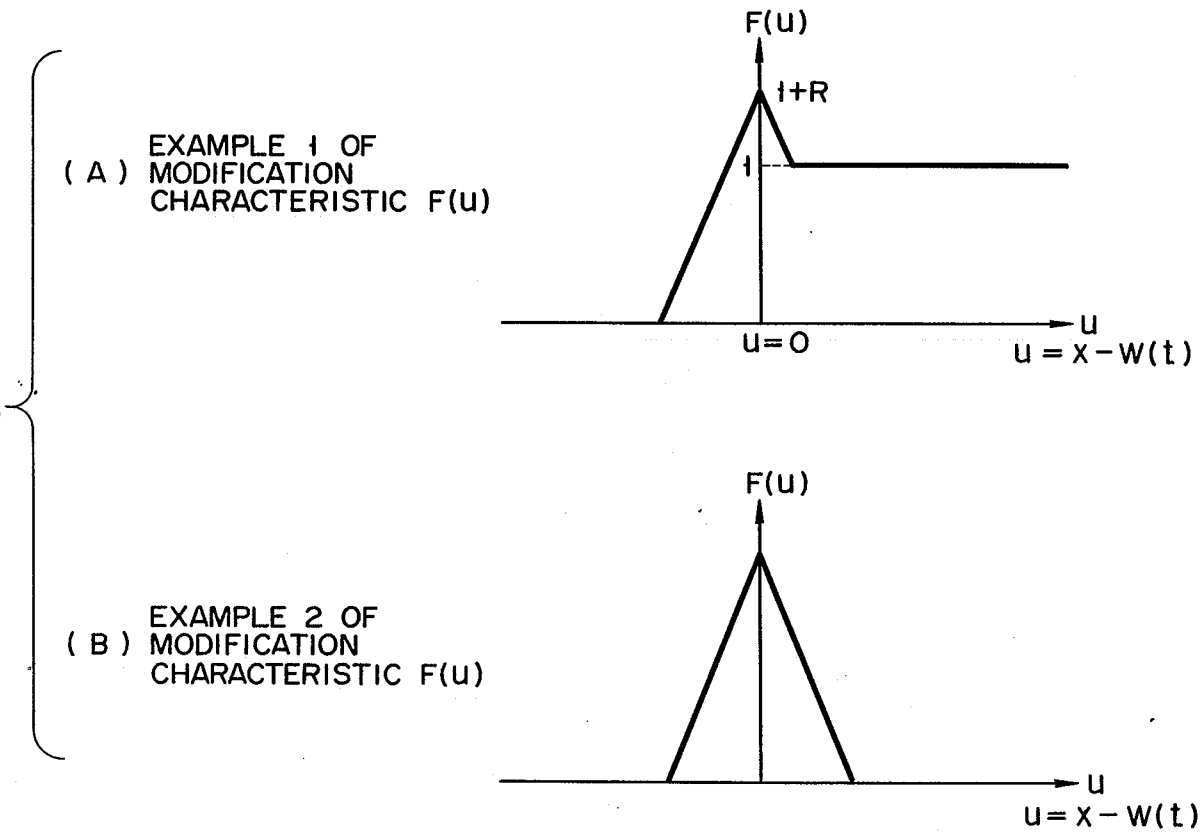
FIGS. 7(A) and 7(B) are waveform charts showing other envelope modifications for obtaining a high-pass filter type and band-pass filter type resonance effects in the envelope modification device in FIG. 2.
Figure 12:
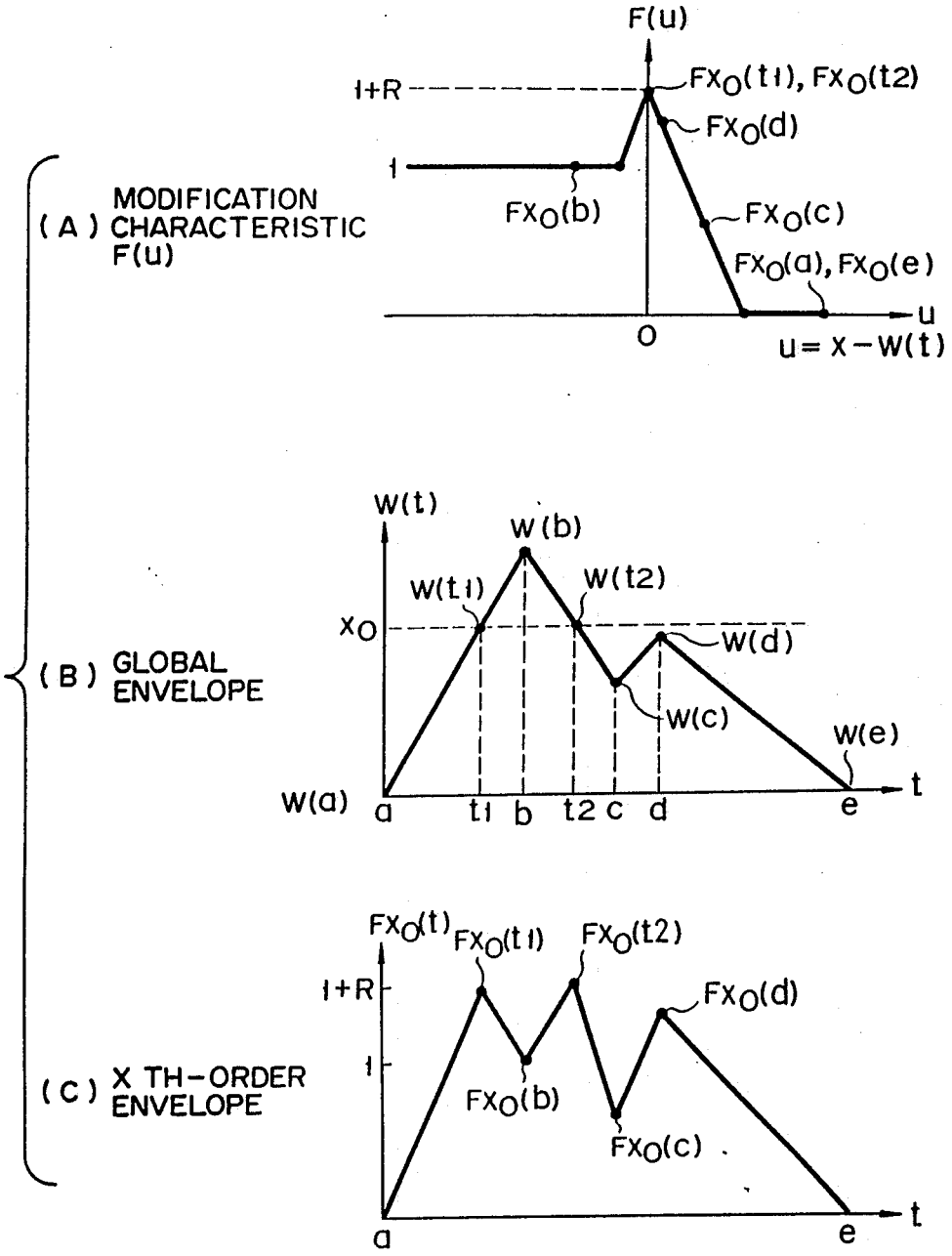
FIGS. 12(A) to 12(C) are waveform charts for explaining the operation of the envelope modification device shown in FIG. 11.

Assume that x is the order, i.e., the value of the harmonic data from harmonic data memory 10, that w(t) is the global envelope function, i.e., the output from envelope generator 12, and that R is the depth of resonance i.e., $R=F(0)-1$, in view of FIGS. 6(A), 7(A) and 12(A), and R represents a degree to which a tone signal is emphasized at the cutoff point of a filter. Xth-order envelope function Fx(t) modified by envelope generator 12 satisfies the following conditions:

(a) If $x<w(t)$ and $f(x-w(t))+R<1$, then $Fx(t)=1$ (b) If $x \geqq w(t)$ or $f(x-w(t))+R \geqq 1$, then $Fx(t)=f(x-w(t))+R$(if $f(x-w(t))+R<0$, then $Fx(t)=0$)

A substitution of $x-w(t)$ into u yields the following conditions for f(u):

(c) If $u<0$, then $f'(u)>0$ (d) If $u=0$, then $f(u)=1$ (e) If $u>0$, then $f'(u)<0$ Therefore, if $u=0$, i.e., if the order value x is equal to value W(t) of the global envelope function, f(u) takes the maximum value. The value of f(u) is decreased when the absolute value of difference u is increased.

Xth-order envelope function Fx(t) is expressed as a function of time t. When xth-order envelope function Fx(t) is expressed as a function of difference u, function F(u) is derived. The value of function F(u) is changed in accordance with order x relative to value W(t) of global envelope function at arbitrary time t. Therefore, function F(u) determines the modification characteristic for modifying the global envelope function into envelope functions of the respective orders. An example of modification characteristic function F(u) is shown in FIG. 6(A). A difference obtained by subtracting the value of global envelope function W(t) from order x is plotted along abscissa u. As shown in FIG. 6(A), near $u=0$, i.e, in the range of order x closer to the value of global envelope function W(x), F(u) is amplified. However, if $u<<0$, then $F(u)=1$. If $u>>0$, then $F(u)=0$. Therefore, modification characteristic function F(u) provides a resonance effect for emphasizing the component closer to the cutoff frequency of the low-pass filter.

The resonance effect can be dynamically given. More specifically, the value of global envelope function W(t) is changed as a function of time t. When specific order $x_0$ is given, a value obtained by subtracting W(t) from order $x_0$ is also changed as a function of time along the u-axis in FIG. 6(A). The value of each F(u), i.e., value $Fx_0(t_i)$ of the $x_0$th-order envelope function at time $t_i$ is also changed. According to FIG. 6(A), the value of $Fx_0(t_i)$ is one (1) and is not thus attenuated if order x is sufficiently smaller (lower) than value $W(t_i)$ of the global envelope function at time $t_i$. However, if order x is sufficiently larger (higher) than value $W(t_i)$ of the global envelope function at time $t_i$, the value of $FX_0(t_i)$ is zero and is thus perfectly attenuated. If order x is very close to value $W(t_i)$ of the global envelope function at time ti, the value of $Fx_0(t_i)$ can be amplified to a value of one or more.

In other words, the order of an envelope function having an amplified value at a given time is close to the value of the global envelope function at the given time. Therefore, the order of the emphasized component wave is changed as a function of time, thereby obtaining the resonance effect which is dynamically changed as a function of time.

Modification into envelope functions of the respective orders will be described in detail. Assume that global envelope function W(t) shown in FIG. 6(B) is supplied from global envelope memory 3 through envelope generator 12. Specific order $x_0$ has a dotted level. In this case, envelope modification device 14 shown in FIG. 2 produces $x_0$th-order envelope function $Fx_0(t)$ shown in FIG. 6(C) in accordance with modification characteristic F(u) shown in FIG. 6(A).

In order to readily understand modification, the values of $x_0$th-order envelope function $Fx_0(t)$ which correspond to several values of global envelope function W(t) shown in FIG. 6(B) are written in FIG. 6(A). For example, as shown in FIG. 6(B), values $W(t_1)$ and $W(t_2)$ of the global envelope function are equal to the value of order $x_0$ at times $t_1$ and $t_2$. Therefore, u=0 is established. The value of F(u) at position for u=0 in FIG. 6(A) are values $Fx_0(t_1)$ and $Fx_0(t_2)$ of the $x_0$-th order envelope function at times $t_1$ and $t_2$. The values of $x_0$th-order envelope function $Fx_0(t)$ at other times can be obtained in the same manner as described above.

In practice, envelope modification device 14 shown in FIG. 2 performs modifications for all data values of global envelope function W(t) in the form of waveform data supplied from envelope generator 12.

Envelope modification device 14 can be arranged in various ways. For example, device 14 can comprise a subtracter for calculating a difference between the instantaneous value of global envelope function W(t) from envelope generator 12 and the value of order x from harmonic data memory 10, and a memory addressed in response to output data from the subtracter and adapted to store modified envelope function waveform data values. Alternatively, if modification characteristic function F(u) or f(x−W(t)) is a function to be calculated, envelope modification device 14 can be achieved by a proper algorithm. For example, a difference between the order value x and the value of the global envelope function is calculated such that $u=x-W(t)$. By utilizing difference u, f(x−W(t)) is calculated and is added to resonance value R, thereby obtaining f(x−W(t))+R. Whether difference u is negative is determined or whether f(x−W(t))+R is 1 or less is determined. If both these conditions are established (corresponding to x<W(t) and f(x−W(t))+R<1), constant 1 is used as the modified envelope function value. If neither conditions are established (corresponding to x≧W(t) or f(x−W(t))+R≧1), whether f(x−W(t))+R is negative is determined. If value f(x−W(t))+R is not negative, this value serves as the modified envelope function value. If value f(x−W(t))+R is negative, constant 0 serves as the modified envelope function value.

Modification characteristic F(u) of the global envelope function/envelope functions of the respective orders is not limited to ones shown in FIG. 6(A) or in modification conditions (a) to (e). The illustrated modification characteristic is an example for obtaining a low-pass filter type resonance effect. For example, within the range of u<<0, the characteristic is perfectly flat since F(u)=1. However, the characteristic may be almost flat. The position for u=0, i.e., x=W(t) is the center of resonance. However, x=W(t)+K (where K is a constant) may be the central position of the resonance. Alternatively, cx=W(t) (where c is a constant or cx is an increment function of x) may be the central position of the resonance. In the former case, (x−K) can be evaluated as the value of order x. In the latter case, cx can be evaluated as the value of order x.

Modification characteristic F(u) may be selected to obtain a high-pass filter type resonance effect in place of the low-pass filter type resonance effect.

A modification characteristic for the high-pass filter type resonance effect is shown in FIG. 7(A). This modification characteristic is obtained by changing conditions (a) and (b) of conditions (a) to (e) and using the following condition in place of condition (a): T,0240

Modification characteristic F(u) may be selected to obtain a band-pass filter type resonance effect, as shown in FIG. 7(B).

The modification characteristic for the band-pass filter type resonance effect is obtained by using conditions (c), (d), and (e) of conditions (a) to (e) without changes and the following condition in place of conditions (a) and (b):

$Fx(t)=f(x-W(t))+R$ (if $f(x-W(t))+R<0$, then $Fx(t)=0$)

Resonance value R need not be a constant but a variable which can be changed by the user. In this case, the resonance value can be preferably changed in real time during musical performance in the following manner. When envelope modification device 14 shown in FIG. 2 is used, changing resonance value R is used in the process for producing envelope functions Fx(t) of the respective orders in the form of waveform data from global envelope function W(t) in the form of waveform data.

The operation of envelope modification device 14 in FIG. 2 will be described when waveform data of envelopes of the respective orders for obtaining a low-pass filter effect is to be generated.

In this case, envelope modification device 14 performs the following modifications to produce envelopes of the respective orders:

(f) If $x<W(t)$, then $Fx(t)=1$ (g) If $x>W(t)$, then $Fx(t)=f(x-W(t))$ (if $f(x-W(t))<0$, then $Fx(t)=0$) where x is the order (corresponding harmonic data), W(t) is the global envelope function (output from envelope generator 12), and Fx(t) is the modified envelope function (output from envelope modification device 14). Let x−W(t) be u, then f(u) satisfies the following conditions:

(h) If u=0, then $f(u)=1$ (i) If u>0, then $f'(u)<0$

Figure 8:
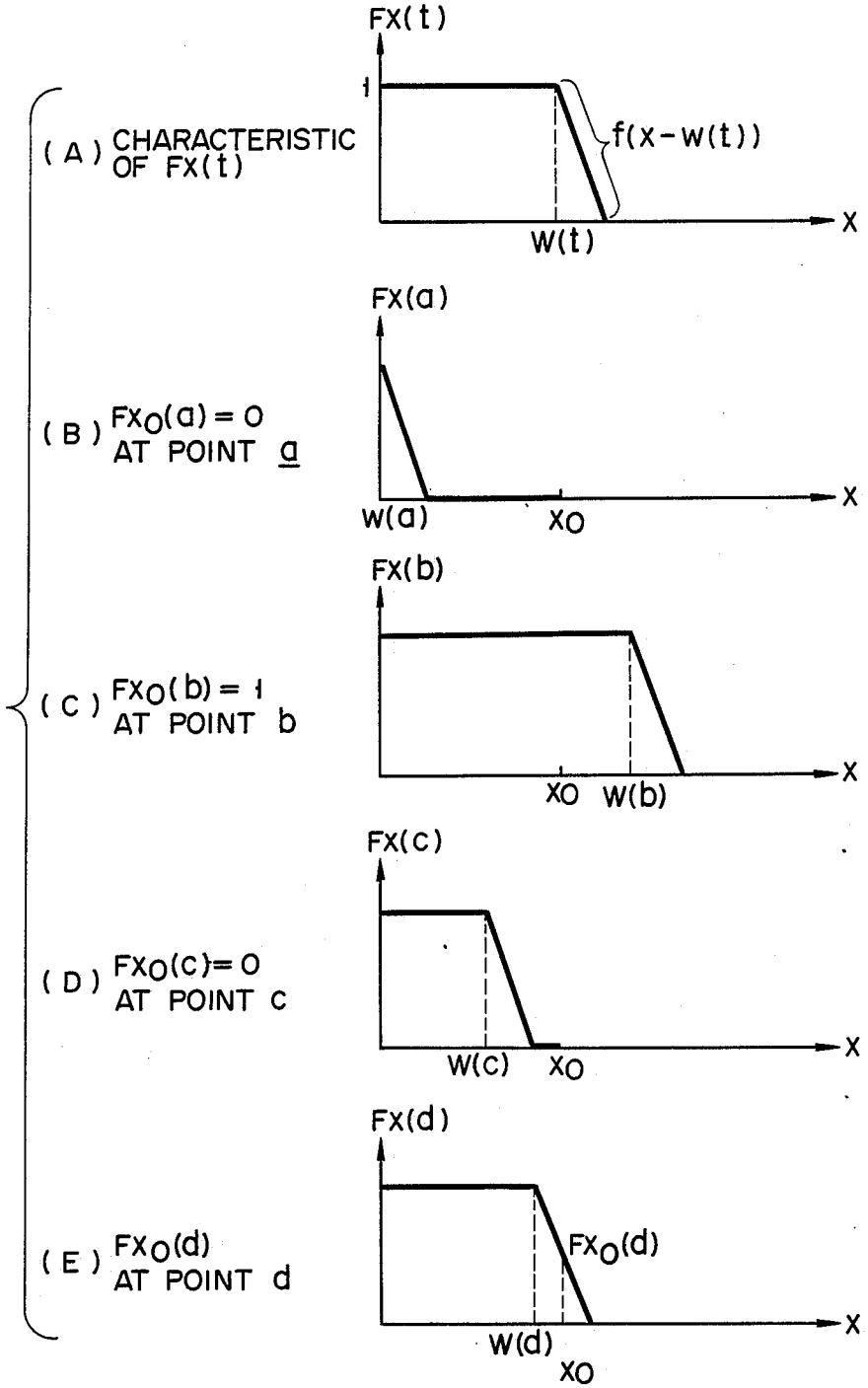
FIGS. 8(A) to 8(E) and FIGS. 9(A) and 9(B) are waveform charts showing still other envelope modifications for obtaining a low-pass filter effect in the envelope modification device in FIG. 2.

When order x is smaller than the value of global envelope function W(t), Fx(t) is 1. However, when order x is larger than the value of global envelope function W(t), the gradient of Fx(t) is negative. An example of this function is shown in FIG. 8(A). FIG. 8(A) shows the characteristic of function Fx(t) when order x is plotted along the abscissa. Although function W(t) is a function of the global envelope function, its value is changed as a function of time t. If specific order $x_0$ is given, the value of $x_0$th-order envelope function $Fx_0(t)$ is changed in accordance with the value at each time of global envelope function W(t). In the range of $x_0 \leqq W(t)$, $x_0$th-order envelope function $Fx_0(t)$ is not attenuated. However, in the range of $x_0 > W(t)$, the function is greatly attenuated when a difference between $x_0$ and W(t) is larger.

Figure 9:
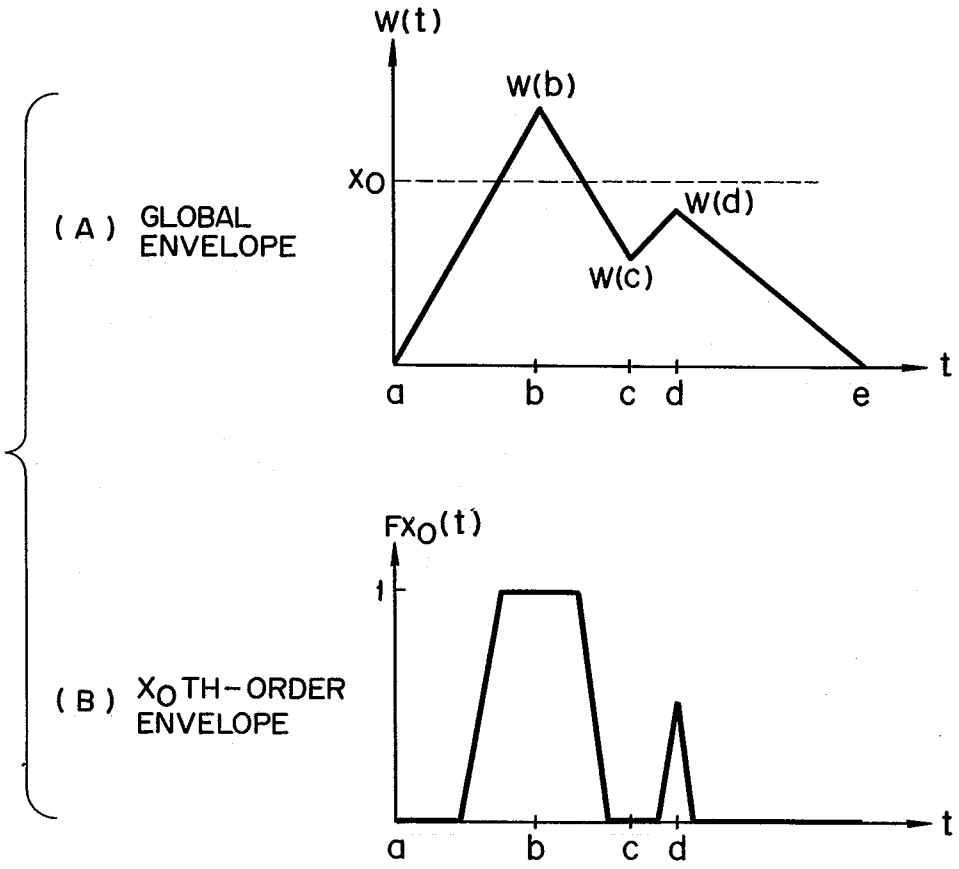

Assume that global envelope function W(t) shown in FIG. 9(A) is supplied from global envelope memory 3 through envelope generator 12. Specific order $x_0$ has the dotted level. In this case, $x_0$th-order envelope modification device 14 generates $x_0$th-order envelope function $Fx_0(t)$ shown in FIG. 9(B) in accordance with the modification characteristic shown in FIG. 8(A).

The value of global envelope function W(t) shown in FIG. 9(A) at time a is W(a)=0 and is sufficiently smaller than the value of order $x_0$ of interest. As shown in FIG. 8(B), value $Fx_0(a)$ of $x_0$th-order envelope function $Fx_0(t)$ at time a is completely attenuated and is zero. Similarly, since value W(c) of the global envelope function time c is sufficiently smaller than the value of order $x_0$, value $Fx_0(c)$ of the modified envelope function is also zero, as shown in FIG. 8(D). Even at time b when global envelope function W(t) has a maximum value, its value W(b) is larger than the value of order $x_0$. Therefore, value $Fx_0(b)$ of the modified envelope function is not attenuated and is 1, as shown in FIG. 8(C). Value W(d) of the global envelope function at time d is slightly smaller than the value of order $x_0$. For this reason, order $x_0$ is located in the region of the attenuation curve of f(x−W(t)) shown in FIG. 8(A). The modified envelope function value is value $Fx_0(d)$ between 0 and 1 in accordance with the characteristic of attenuation curve f(x−W(t)), as shown in FIG. 8(E).

In practice, envelope modification device 14 performs modifications for all data values of global envelope function W(t) in the form of waveform data supplied from envelope generator 12. As a result, envelope function $Fx_0(t)$ in the form of waveform data shown in FIG. 9(B) is calculated.

Envelope functions of higher orders than order $x_0$ are attenuated as compared with the $x_0$th-order envelope function. As a result, an effect similar to a low-pass filter can be obtained.

Envelope modification device 14 can be arranged in various ways. For example, envelope modification device 14 comprises a subtracter for calculating a difference between the instantaneous value of the global envelope function output from envelope generator 12 and the value of the order from harmonic data memory 10, and a memory addressed in response to output data from the subtracter to store waveform data of the modified envelope function. Alternatively, if f(x−W(t)) in FIG. 8(A) can be calculated, a calculation program is executed. For example, the value of order x and the instantaneous value of global envelope function W(t) are compared. If the value of order x is smaller than the instantaneous value of the envelope function, the modified envelope function value serves as a constant. However, if the value of order x is larger than the instantaneous value, instantaneous value W(t) is used to calculate f(x−W(t)). The sign of f(x−W(t)) is determined. If value f(x−W(t)) is positive, the result serves as the modified envelope function value. Otherwise, zero serves as the modified envelope function value.

A modification characteristic for the global envelope function/envelope functions of the respective orders is not limited to the one shown in FIG. 8(A).

For example, in the range of $x \leqq W(t)$ in FIG. 8(A), function Fx(t) is perfectly flat but may be almost flat. The position of $x = W(t)$ is the attenuation start point associated with the cutoff point. However, $x = W(t) + K$ (where K is a constant) may be the attenuation start point. Alternatively, $cx = W(t)$ (where c is a constant) may be the attenuation start point. In the former case, (x−K) can be regarded as the value of the order. In the latter case, cx can be regarded as the value of the order.

An operation of envelope modification device 14 shown in FIG. 2 will be described when waveform data for envelopes of the respective orders for obtaining an effect similar to the high-pass filter is generated.

In this case, envelope modification device 14 performs the following modifications to generate envelopes of the respective orders:

(j) If $x > W(t)$, then $Fx(t) = 1$ (k) If $x \leqq W(t)$, then $Fx(t) = f(x - W(t))$ (if $f(x - W(t)) < 0$, then $Fx(t) = 0$) where x is the order (corresponding harmonic data), W(t) is the global envelope function (output from envelope generator 12), and Fx(t) is the converted envelope function (output from envelope modification device 14). A substitution of x−W(t) into u yields the following conditions for f(u):

(l) If u=0, then $f(u) = 1$ (m) If u<0, then $f'(u) > 0$

In addition, if $f(u) = 1$ is established for u>0, the result coincides with $Fx(t) = 1$ for $x > W(t)$. This f(u) determines the modification characteristic with the envelope function of a given order derived from the global envelope function.

Figure 10:
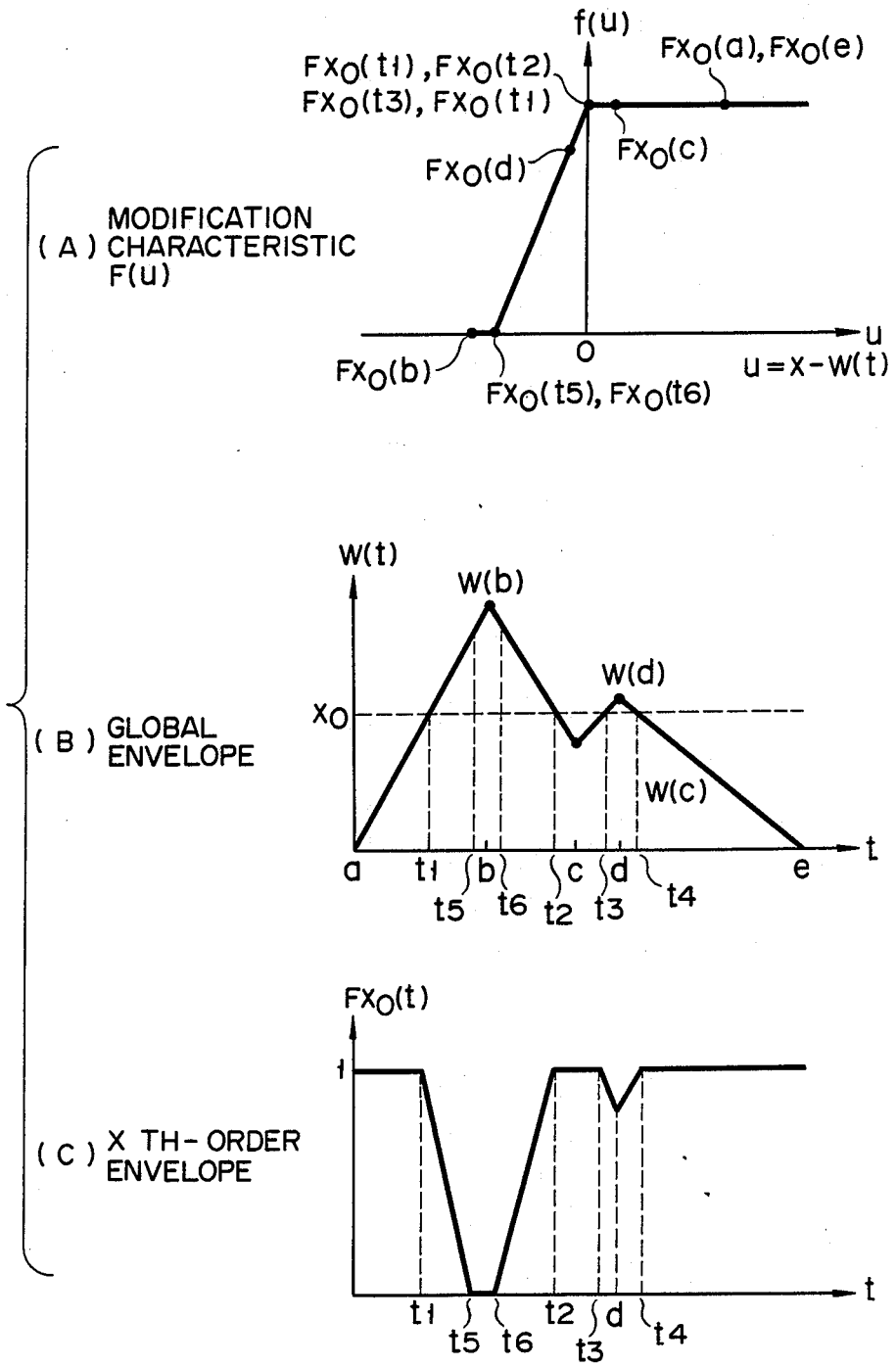
FIGS. 10(A) to 10(C) are waveform charts showing still other envelope modifications for realizing a high-pass filter effect in the envelope modification device in FIG. 2.

If the value of order x is larger than the value of global envelope function W(t), function f(u) is set to be 1. However, if the value of order x is smaller than the value of global envelope function W(t), the function f'(u) which is the gradient of function F(u) is positive. An example of such a modification characteristic is shown in FIG. 10(A). Difference u is plotted along the abscissa and obtained by subtracting the value of global envelope function W(t) from the value of order x. In general, global envelope function W(t) is changed as a function of time t. Therefore, if specific order $x_0$ is given, a value obtained by subtracting the value W(t) from order $x_0$ is also changed as a function of time and is moved along the u-axis in FIG. 10(A). The value of each f(u), i.e., value $Fx_0(t_i)$ of the $x_0$th-order envelope function at each time $t_i$ is also changed. The value of $Fx_0(t_i)$ is not attenuated in the range of $x_0 \geqq W(t)$. However, the value of $Fx_0(t_i)$ is greatly attenuated in the range of $x_0 < W(t)$ when the difference between $x_0$ and W(t) is increased.

Assume that global envelope function W(t) shown in FIG. 10(B) is supplied from global envelope memory 3 through envelope generator 12. Specific order $x_0$ has a dotted level. In this case, envelope modification device 14 generates $x_0$th-order envelope function $Fx_0(t)$ shown in FIG. 10(C) in accordance with the modification characteristic shown in FIG. 10(A).

In order to readily understand the modification, values of the $x_0$th-order envelope function which correspond to several values of global envelope function W(t) shown in FIG. 10(B) are written. For example, $Fx_0(d)$ is the value of the $x_0$th-order envelope function at time d. As is apparent from FIG. 10(B), W(d) is slightly larger than $x_0$ at time d. In other words, the value of u is negative. The point on f(u) at the position of u in FIG. 10(A) is calculated. The obtained point represents $Fx_0(d)$. Other points can be obtained in the same manner as described above.

In practice, envelope modification device 14 performs modifications for all data values of global envelope function W(t) in the form of waveform data supplied from envelope generator 12. As a result, envelope function $Fx_0(t)$ in the form of waveform data shown in FIG. 10(C) is calculated for the $x_0$th order.

It is apparent from the above description that envelope functions having orders smaller than the $x_0$th-order are attenuated as compared with the $x_0$th-order envelope function. As a result, an effect similar to a high-pass filter can be obtained.

Envelope modification device 14 can be arranged in various ways. For example, envelope modification device 14 comprises a subtracter for calculating a difference between the instantaneous value of the global envelope function output from envelope generator 12 and the value of the order from harmonic data memory 10, and a memory addressed in response to output data from the subtracter to store waveform data of the modified envelope function. Alternatively, if f(x−W(t)) in condition (k) can be calculated, a calculation program is executed. For example, the value of order x and the instantaneous value of global envelope function W(t) are compared. If the value of order x is larger than the instantaneous value of the envelope function, the modified envelope function value serves as a constant. However, if the value of order x is smaller than the instantaneous value, instantaneous value W(t) is used to calculate f(x−W(t)). The sign of f(x−W(t)) is determined. If value f(x−W(t)) is positive, the result serves as the modified envelope function value. Otherwise, zero serves as the modified envelope function value.

A modification characteristic for the global envelope function/envelope functions of the respective orders is not limited to the one shown in FIG. 10(A).

For example, in the range of u>0, i.e., $x>W(t)$ in FIG. 10(A), function Fx(t) is perfectly flat but may be almost flat. The position of u=0, i.e., x=W(t) is the attenuation start point associated with the cutoff point. However, $x=W(t)+K$ (where K is a constant) may be the attenuation start point. Alternatively, $cx=W(t)$ (where c is a constant or cx is an increment function) may be the attenuation start point. In the former case, (x−K) can be regarded as the value of the order. In the latter case, cx can be regarded as the value of the order.

Envelope modification device 14 described above generates envelope functions in the form of waveform data by using the global envelope functions in the form of waveform data and the order data. At the same time, all values of the waveform data of the global envelope are modified.

Figure 11:
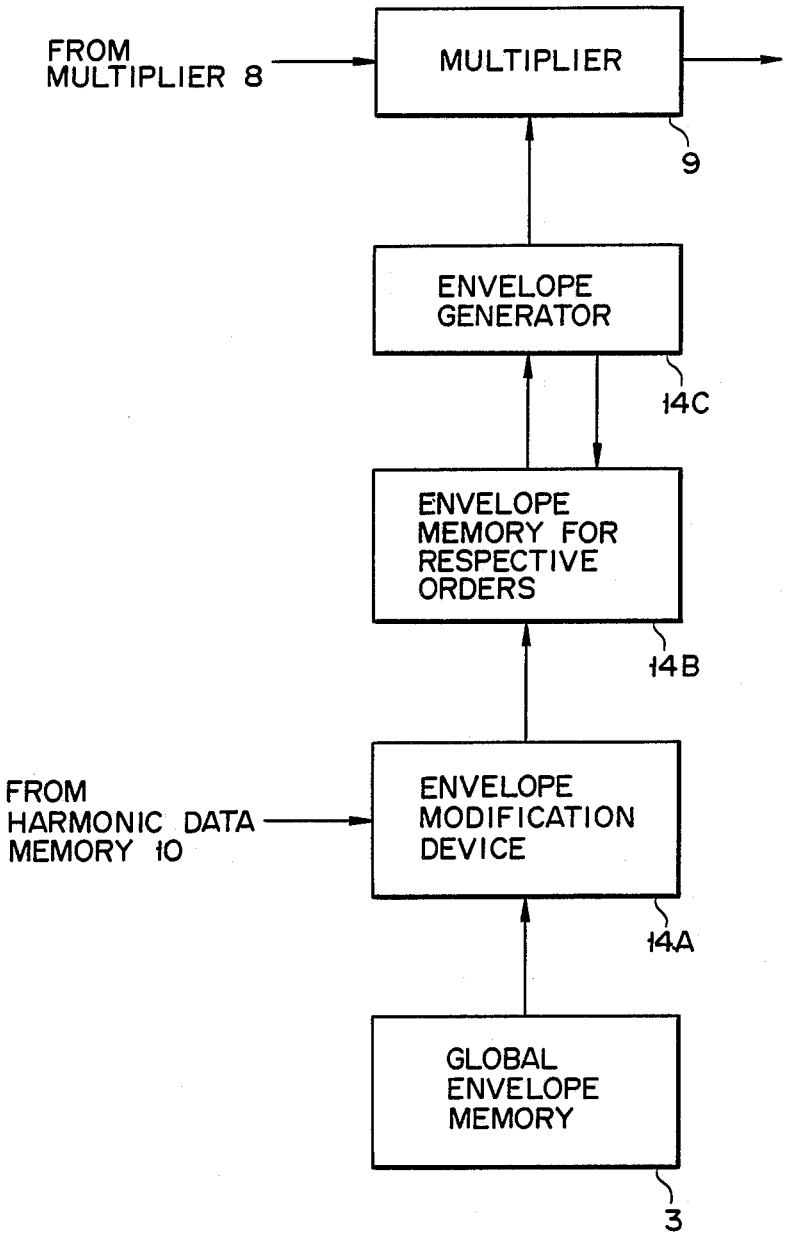
FIG. 11 is a block diagram showing a partial modification of the circuit in FIG. 2.

To the contrary, an arrangement shown in FIG. 11 modifies a global envelope function expressed by a set of rate data and level data shown in FIG. 4 into envelope functions of the respective orders. In other words, several points of global envelope function W(t) are modified in accordance with modification characteristic F(u). These points include peak or break points (i.e., points corresponding to W(a), W(b), W(c), W(d), and W(e) in FIG. 12) on global envelope function W(t) and points (i.e., points corresponding to $W(t_1)$ and $W(t_2)$) in which the values of function W(t) coincide with the values of order x.

Envelope modification device 14A in FIG. 11 executes the following algorithm to obtain a set of rate data and level data which express the $x_0$th-order envelope function in accordance with the set of rate and level data which define the global envelope data.

l(i) and r(i) are level and rate data of the ith step of the global envelope function, and L(j) and R(j) represent level and rate data of the jth step of the $x_0$th-order envelope function to be stored in envelope memory 14B for respective orders. In addition, l(old) represents the previous level of the point on the global envelope function. The initial value of level l(old) is zero, and L(0) is also zero. Both initial values of i and j are 1.

(1) Level l(i) and rate r(i) of the current step are read out from global envelope memory 3.

(2) Whether condition $l(old)<x_0<l(i)$ or $l(old)>x_0>l(i)$ is established is determined (that is, whether the value of order $x_0$ is present between the previous and current values of the global envelope functions is determined). If this determination is established, the flow advances to (3). Otherwise, the flow advances to (7).

(3) Let (1+R) be level L(j) of the $x_0$th-order envelope function (that is, the jth level of the $x_0$th-order envelope function is obtained).

(4) A division $(x_0-l(old))/r(i)$ is calculated, and the quotient is given as t (e.g., time $t_1$ between point W(a) and the next point $W(t_1)$ in FIG. 12(B) is calculated).

(5) A division (L(j)−L(j−1))/t is calculated, and the quotient is given as rate R(j) (that is, the jth rate of the $x_0$th-order envelope function is calculated).

(6) The value of order $x_0$ is set in l[old), and the count of j is incremented by one.

(7) A difference $F(x_0-l(i))$ is calculated, and let the difference be level L(j) (that is, the jth level of the $x_0$th-order envelope function is obtained in accordance with modification characteristic F(u) for obtaining a low-pass filter type resonance effect).

(8) A division (l(i)−l(old))/r(i) is calculated and the quotient is given as t (e.g., time between point $W(t_1)$ in FIG. 12(B) and the next point W(b) is calculated; see step (4)).

(9) A division (L(j)−L(j−1))/t is calculated and the quotient is defined as the jth rate R(j) of the $X_0$th-order envelope function.

(10) Set the value of l(i) in l(old), and both the values of i and j are incremented by one. If i<5, the flow returns to step (1). However, if i=5, then the flow is ended.

By performing the above processing, sets of rate and level data {(L(1),R(1)), (L(2),R(2)), . . . } which define the $x_0$th-order envelope function (FIG. 12(C)) are stored in envelope memory 14B for the respective orders. The above algorithm is an example, and similar envelope functions can be obtained by using other algorithms.

Envelope generator 14C has an arrangement similar to that of envelope generator 12 shown in FIG. 2. In response to key depression on keyboard 1 (FIG. 1), rate and level data are read out from the first step from envelope memory 14B for the respective orders. The envelope functions of the respective orders which are expressed by rate and level data are sequentially changed into waveform data. The amplitudes of sine wave data of the corresponding orders which are output from multiplier 8 are controlled by multiplier 9 in accordance with the waveform data sequentially generated by envelope generator 14C.

The above description has been made to clarify a low-pass filter type resonance effect of modification characteristic F(u) executed in envelope modification device 14A shown in FIG. 11.

Figure 13:
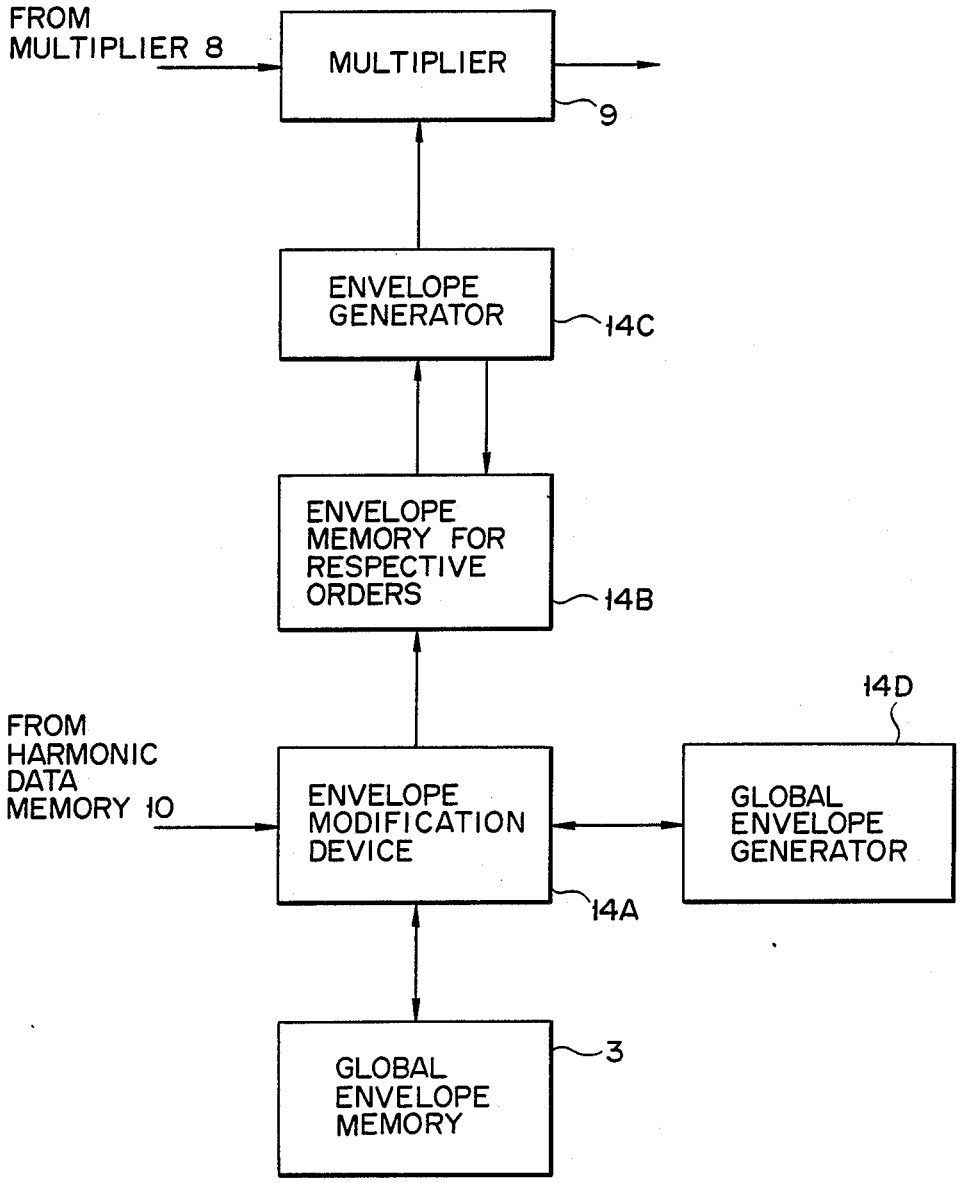
FIG. 13 is a circuit diagram of a device arranged by further modifying part of the envelope modification device in FIG. 2.

FIG. 13 shows a modification obtained by partially modifying the circuit arrangement in FIG. 11. Envelope modification device 14A cooperates with global envelope generator 14D to modify the global envelope function from global envelope memory 3 into envelope functions of the respective orders expressed in the same form as that of the global envelope function. Global envelope generator 14D calculates an instantaneous value of the global envelope function and basically comprises an accumulator. After the rate data is set by envelope modification device 14A, envelope generator 14D adds rate data to the accumulated value every time a clock is supplied from envelope modification device 14A. An accumulation result is output to envelope modification device 14A. Envelope modification device 14A comprises a level coincidence detector for detecting a coincidence between the accumulation result from global envelope generator 14D and global envelope predetermined level data, and an order coincidence detector for detecting a coincidence between the accumulation result and the order data. If the coincidence is established, the accumulation result is modified in accordance with modification characteristic F(u) to obtain level data of envelopes of the respective orders (The arrangement required for modification itself is substantially the same as the corresponding section in envelope modification device 14 shown in FIG. 2). If a coincidence signal is output from the level coincidence detector, global envelope generator 14D is reset in accordance with the rate data of the next envelope step. In addition, in order to obtain time information, envelope modification device 14A comprises a counter for counting an operation count of each envelope step in global envelope generator 14D and a circuit for calculating rate data of the envelopes of the respective orders in accordance with a difference between the level data and time data as the contents of the counter.

For example, envelope modification device 14A reads out the rate and level data of step 1 for global envelope function W(t) shown in FIG. 12(B) (corresponding to the interval between time a and time b in FIG. 12(B)) from global envelope memory 3. The level data is set in the internal level coincidence detector, and the rate data is set in global envelope generator 14D. Envelope modification device 14A supplies a clock signal to generator 14D to allow an accumulation operation and increments the count of the internal counter by one. At time $t_1$, the internal order coincidence detector detects a coincidence between the global envelop function value (output from global envelope generator 14D) and the value of order $x_0$. In this case, envelope modification device 14A modifies the function value in accordance with modification characteristic F(u) shown in FIG. 12(A). The modified result is assured as the level data of the first step of the $x_0$th-order envelope function. A difference between this level data and the immediately preceding step level data (in this case, no preceding step is present, and the previous level data represents zero) is calculated. The difference is divided by the count of the counter, i.e., the value representing the time of the first step of $x_0$th-order envelope function $Fx_0(t)$. The quotient is assured as the rate data of the first step of the $x_0$th-order envelope function. The counter is initialized for the second step of the $x_0$th-order envelope function.

The operation of global envelope generator 14D is started again. The count of the internal counter is incremented by one every time the accumulation cycle is completed. When the count of the counter reaches a predetermined value (corresponding to time b in FIG. 12(B)), the level coincidence circuit detects that the global envelope function value as the accumulation result has reached the predetermined level. In the same manner as described above, envelope modification device 14A calculates the level and rate data of the second step of the $x_0$th-order envelope function. Thereafter, the rate and level data of the next step are read out from global envelope memory 3 and the above operations are repeated.

As a result, envelope control information (i.e., set of rate and level data) for describing the $x_0$th-order envelope function shown in FIG. 12(C) are obtained. The control information is temporarily stored in envelope memory 14B for the respective orders.

Envelope generator 14C has the same arrangement as that of envelope generator 12C of FIG. 11. In response to key depression on keyboard 1 (FIG. 1), rate and level data are read out from the first step from envelope memory 14B for respective orders. The envelope functions of the respective orders expressed by the rate and level data are sequentially changed into waveform data.

In this manner, the envelopes of the respective orders expressed by the rate and level data can be derived from the global envelope expressed by the rate and level data in FIG. 13.

The above arrangement may be changed to obtain a high-pass filter type resonance effect or a band-pass filter type resonance effect in place of the low-pass filter type resonance effect. In this case, the circuit can be properly designed with reference to FIG. 7, and FIG. 11, 12 or 13 to set the rate and level data which represent the $x_0$th-order envelope function.

The resonance value R need not be a constant but be a variable which can be set by the user. If the resonance value can be changed in real time, a performance effect can be further improved.

An arrangement for performing real time resonance value changes can be obtained by adding to the arrangement of FIG. 11 or 13 a multiplier, arranged between envelope generator 14C and multiplier 9, for multiplying resonance depth coefficient R/R0 (where R0 is the reference resonance depth which is reflected in the data stored in the envelope memory 14B for the respective orders, and R is the resonance value designated by the user) with the output from envelope generator 14C, a selector (its selection output is input to multiplier 9) for selecting an output from the additional multiplier or a direct output from envelope generator 14C, and a comparator for controlling selection of the selector. This comparator compares the output from envelope generator 14C with data of a level (e.g., level corresponding to F(u)=1 in FIG. 12(A)) for switching the output from envelope generator 14C. An output from this comparator is supplied to the selection control input of the selector.

An operation of envelope modification device 14A shown in FIG. 11 will be described when a low-pass filter type resonance effect is to be realized.

If low-pass filter type modification characteristic F(u) satisfying conditions (f) to (i) is provided to envelope modification device 14A shown in FIG. 11, the following algorithm is executed to obtain the $x_0$th-order envelope function expressed by the sets of level and rate data.

(1) Level l(i) and rate r(i) of the current step i are read out from global envelope memory 3.

(2) A function $F(x_0-l(i))$ is calculated, and the result is set as level L(i) of step i of the $x_0$th-order envelope function.

(3) A division $(l(i)-l(i-1))/r(i)$ is calculated, and the quotient is set as time t of step i.

(4) A division $(L(i)-L(i-1))/t$ is calculated, and the quotient is set as rate R(i) of step i of the $x_0$th-order envelope function.

(5) Step number i is incremented by one. If $i<5$, then the flow returns to step (1). However, if $i=5$, then the flow is ended.

Similarly, an arrangement for obtaining a high-pass filter type resonance effect by using envelope modification device 14A in FIG. 11 will be described below.

In order to assign high-pass filter type modification characteristic F(u) satisfying conditions (j) to (m) to envelope modification device 14A in FIG. 11, the same algorithm as the algorithm consisting of steps (1) to (5) described with reference to the low-pass filter type resonance effect is performed to obtain the $x_0$th-order envelope function expressed by sets of rate and level data (however, the algorithm in this case is different from the that of steps (1) to (5) in that $F(x-l(i))$ is calculated to obtain level L(i) of each step of the $x_0$th-order envelope function).

In each arrangement described above, the filter characteristic is obtained by using as a parameter difference u between the value of order x and global envelope function value W(t). The present invention can be easily modified to perform modifications for performing a filter effect having several pass or stop bands.

A very simple modification characteristic will be described below.

In this arrangement, only level data of the global envelope function expressed by sets of rate and level data are modified. That is, when level data of each step of the global envelope function is represented by LEVEL, the following modification is performed:

$$LEVEL \rightarrow F(X,LEVEL)$$

The right-hand side F(x,LEVEL) represents the level of the step corresponding to the xth-order envelope function.

For example, F(x,LEVEL) is given as follows:

$$F(x,LEVEL)=100[1-\{1-(LEVEL/100)\}x] \quad (1)$$

In this case, modified level F(x,LEVEL) is changed in accordance with the values of order x as follows:

(A) 0th Order (x=0)

In this case, level F(x,LEVEL) is given as follows regardless of the level of the global envelope function:

$$F(0,LEVEL)=100$$

Figure 14:
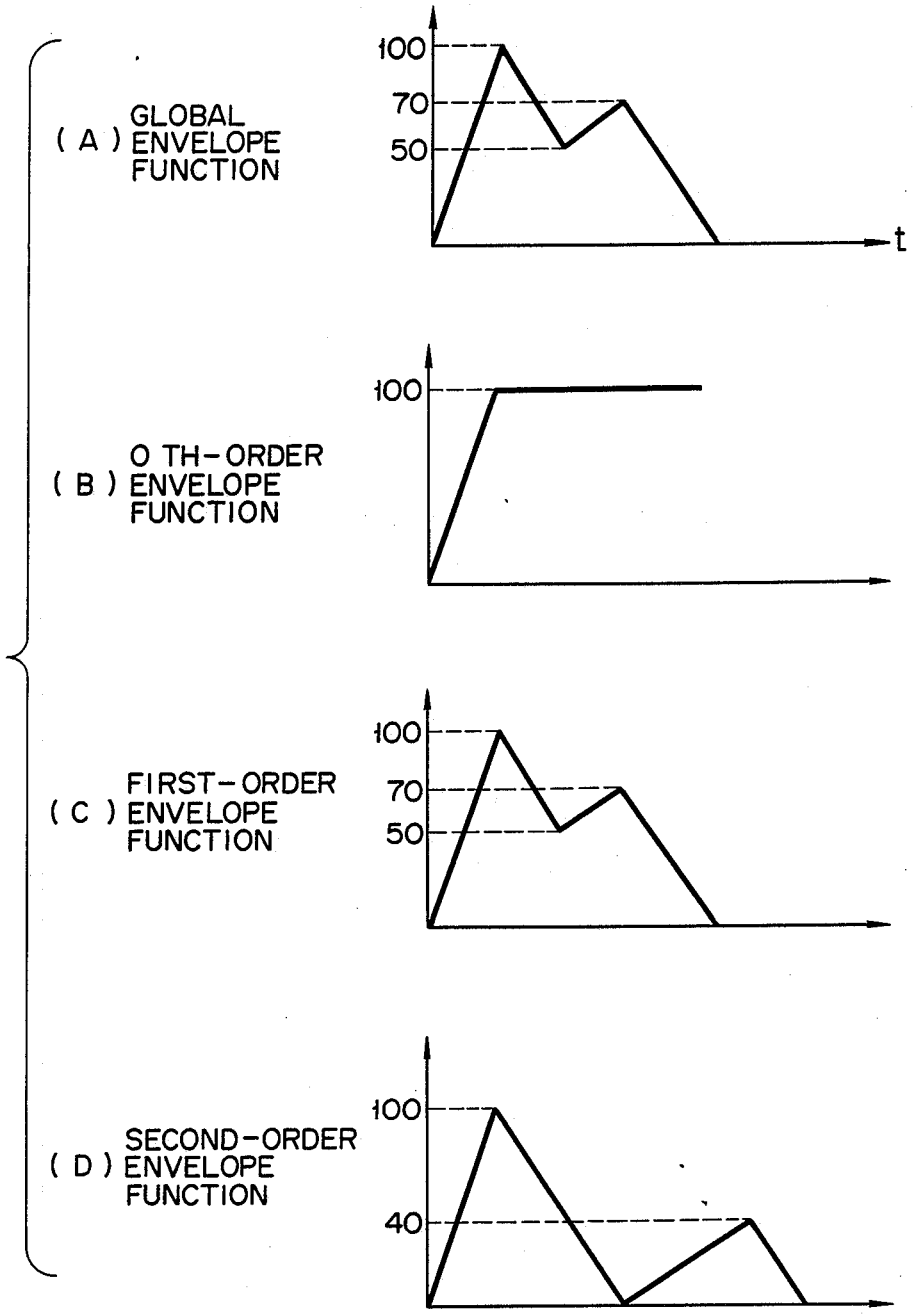
FIGS. 14(A) to 14(D) are waveform charts showing still other envelope modifications for obtaining characteristics for modifying the envelope by only levels in the device shown in FIG. 11.

For example, if the global envelope function is given as shown in FIG. 14(A), the 0th-order envelope function is given as shown in FIG. 14(B). The modified 0th-order envelope function is used to control the envelopes of the 0th-order sine wave, i.e., the sine wave having the fundamental frequency.

(B) First Order (x=1)

$F(1,LEVEL)=LEVEL$ is given. That is, each level of the given global envelope function is always equal to that of the first-order envelope function. The first-order envelope function is the same as the global envelope function (FIG. 14(C)). The waveform data of the first-order envelope function is used to control the envelope of the first-order sine wave signal, i.e., the envelope of the sine wave signal having a frequency of a second harmonic.

(C) Second Order (x=2)

$F(2,LEVEL)=2LEVEL-100$ is given. The level of each step of the global envelope function is doubled, and 100 is subtracted from the doubled value. The resultant difference serves as the corresponding level of the second-order envelope function (FIG. 14(D)). The second-order envelope function is applied to a sine wave having a frequency of a second order, i.e., third harmonic.

Envelope functions of higher orders can be produced in the same manner as described above. If the modification function given in equation (1) is used, the envelope function is attenuated and its amplitude change is small when the order is increased.

Function $100[1-\{1-(LEVEL/100\}x]$ is an example. An arbitrary function may be selected, such as a function having an amplitude which is greatly changed when the order is increased.

The modification of only levels can be easily realized by envelope modification device 14D shown in FIG. 11. For example, the following algorithm can be used:

(1) Rate r(i) of step i from global envelope memory 3 is transferred to envelope memory 14B as rate R(i) of step i of the xth-order envelope function.

(2) Level l(i) of step i is read out from global envelope memory 3.

(3) Function F(x,l(i)) is calculated, and the result is transferred to envelope memory 14B as level L(i) of step i of the xth-order envelope function.

(4) Step number i is incremented by one. If $i<5$, then the flow returns to step (1). However, if $i=5$, the algorithm is ended.

The above level modification can be easily performed by envelope modification device 14 shown in FIG. 2. F(x,W(t)) for each W(t) from envelope generator 12 is calculated.

In the arrangement of FIG. 11, the rate modification in addition to the level modification can be performed as follows:

$$LEVEL \rightarrow F(x,LEVEL)$$

$$Rate \rightarrow G(x,LEVEL)$$

G(x,RATE) is a rate value corresponding to the xth-order envelope function obtained by modifying value RATE of the global envelope function in accordance with the value of order x.

Several arrangements have been described in detail above. The present invention is not limited to these. Various changes, modifications, and improvements may be made. In the above embodiment, a plurality (n) of envelope-controlled sine wave generators 15-l to 15-n are used. However, hardware of a sine generator is not limited if it functionally provides a plurality of sine waves.

For example, at least some of envelope-controlled sine wave generators 15-l to 15-n can be realized by TDM (time-division multiplexing).

Another embodiment of the present invention will be described with reference to FIG. 15.

Figure 15:
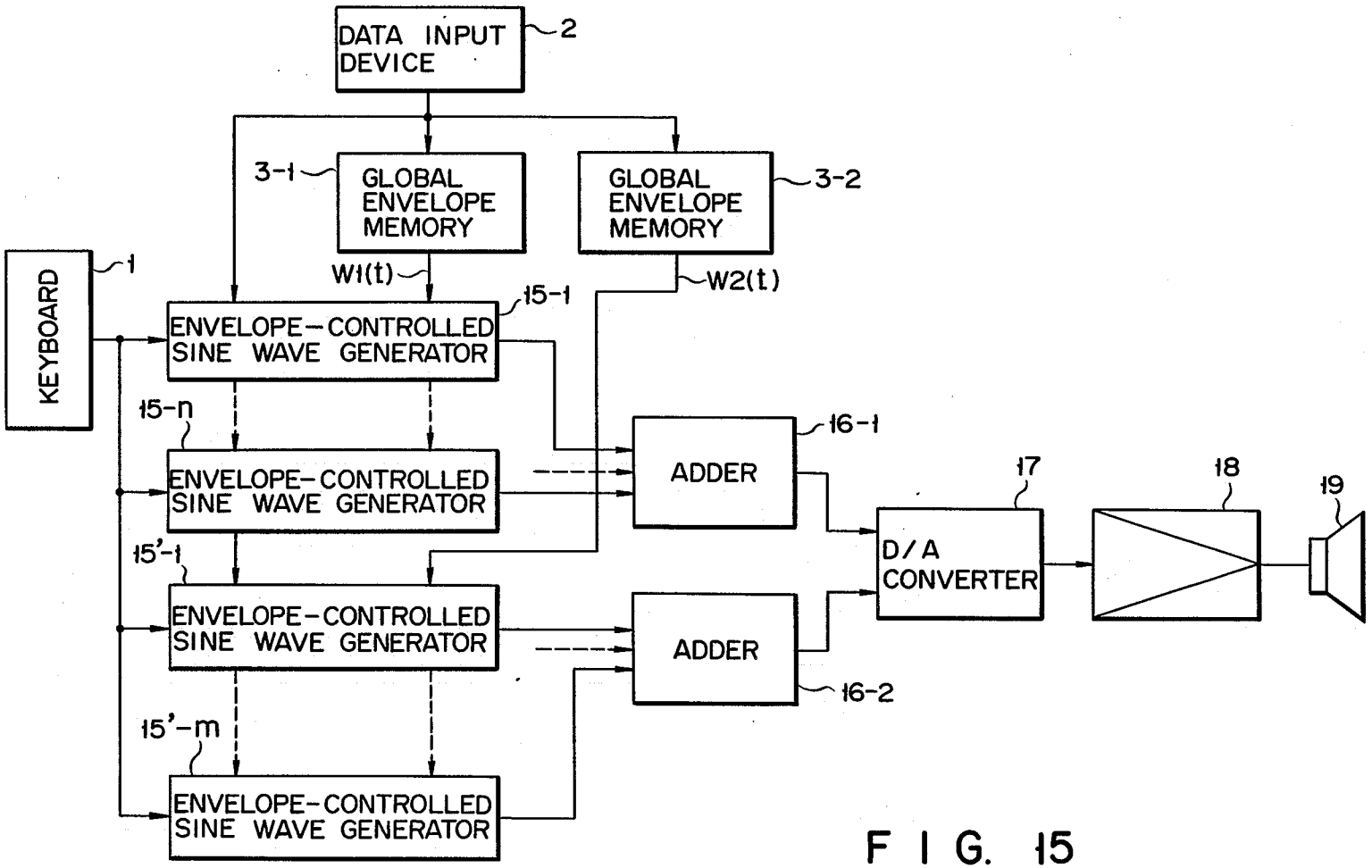
FIG. 15 is a block diagram showing an overall circuit arrangement according to another embodiment of the present invention.

Referring to FIG. 15, the envelope-controlled sine wave generator section is divided into two groups: envelope-controlled sine wave generators 15-l to 15-n as the first group and envelope-controlled sine wave generators 15'-l to 15'-m as the second group. Envelope-controlled sine wave generators 15-l to 15-n and 15'-l to 15'-m are connected to keyboard 1 as a performance input device and data input device 2 for inputting various data. At data input device 2, the user can specify independent harmonic data to the respective groups of envelope-controlled sine wave generators. Sine wave generators 15-l to 15-n and 15'-l to 15'-m can generate different sine waves having independent frequencies on the basis of prestored harmonic data upon key depression at keyboard 1. The feature of this embodiment lies in that the first and second groups constituted by the corresponding envelope-controlled sine wave generators are coupled to the corresponding global envelope memories More specifically, envelope-controlled sine wave generators 15-l to 15-n of the first group are coupled to first global envelope memory 3-1, and envelope-controlled sine wave generators 15'-l to 15'-m of the second group are coupled to second global envelope memory 3-2. First and second global envelope memories 3-1 and 3-2 respectively store first and second global envelope functions W1(t) and W2(t) which are independently set at data input device 2. First global envelope function W1(t) is converted to n envelope functions of n orders determined by the assigned harmonic data (order) in envelope-controlled sine wave generators 15-l to 15-n belonging to the first group. Second global envelope function W2(t) is modified into m envelope functions determined by the assigned harmonic data in envelope-controlled sine wave generators 15'-l to 15'-m belonging to the second group. The modified envelope functions of the respective orders are used to control the envelopes of the sine wave signals of the corresponding orders in envelope-controlled sine wave generators 15-l to 15-n.

In this embodiment, if one envelope (i.e., the global envelope function) is given for sine wave signals of one group, a plurality of envelope functions, i.e., envelope functions of sine wave signals belonging to this group can be obtained based on the given function. The load imposed on the user who produces the envelopes can be greatly reduced. In addition, according &o this embodiment, since independent global envelope functions are set in units of groups, musical tones with a variety of tone colors can be obtained as compared with the arrangement in which a common global envelope is given for all sine waves without dividing a set of sine waves into a plurality of groups.

Referring back to the arrangement of FIG. 15, envelope-controlled sine wave data from envelope-controlled sine wave generators 15-l to 15- and 15'-l to 15'-m are added by adders 16-1 and 16-2, respectively. The sum signals (musical tone signals) are converted into analog signals by D/A converter 17. The analog signals are produced outside through amplifier 18 and loudspeaker 19. Although adders 16-1 and 16-2 are represented as separate units, only one adder can be used to add output data from envelope-controlled sine wave generators 15-l to 15-n and 15'-l to 15'-m.

The detailed arrangement of each envelope-controlled sine wave generator is the same as that in FIG. 2, 11 or 13.

The independent first and second global envelope functions can be arbitrarily set by the user. Independency and flexibility between the global envelope functions are reflected in envelope functions (i.e., the envelope functions for the sine waves of the first group and the envelope functions for the sine waves of the second group) converted by envelope modification device 14 or 14A. Therefore, a variety of finally produced musical tone signals can be achieved.

In the above embodiment, the global envelope functions can be input and set by the user in units of groups. The envelope functions of the first group applied to the sine waves of the first group are independent of the envelope functions of the second group applied to the sine waves of the second group. For example, if the global envelope function shown in FIG. 14(A) is a global envelope function of the first group and a global envelope function entirely different therefrom is a global envelope function of the second group, envelope functions of orders (e.g., 0th, 1st, and 2nd orders) obtained on the basis of the global envelope function of the second group are obviously different from those shown in FIGS. 14(B), 14(C), and 14(D).

Independency between the envelope function groups can be obtained by other means, as has been described above. As compared with other means, the arrangement of this embodiment is more advantageous due to the following reason. In this embodiment, a total number of combinations of the global envelope functions of the first and second groups is greatly increased upon selection by the user. In order to obtain the same effect by other means, e.g., a means for producing different global envelope functions from a given one global envelope function, a large number of modification algorithms and large hardware are required.

In the arrangement of FIG. 15, envelope-controlled sine wave generators 15-l to 15-n of the first group and envelope-controlled sine wave generators 15'-l to 15'-m of the second group are fixedly illustrated. However, the user can arbitrarily determine which generators belong to the first or second group. Some generators may be added or omitted easily within the scope of the present invention.

In the above embodiment, the envelope-controlled sine wave generators are divided into two groups but may be divided into three or more groups. In an extreme case, a given group may use one sine wave.

In the above embodiment, the frequency of the generated sine wave is a fundamental frequency or its harmonic due to the relationship with harmonic data. However, the arrangement is not limited to this. For example, a sine wave having a frequency obtained by detuning the sine wave frequency of the first group may be used as the sine wave of the second group. A technique for generating a sine wave having a detuned frequency is known to those skilled in the art. For example, in phase angle generator 6 in FIG. 2, the repetitive accumulation value of the accumulator is offset by a predetermined number of sent.

In the above embodiment, the plurality of envelope-controlled sine wave generators 15-l to 15-n and 15'-l to 15'-m are used. However, hardware is not limited if a plurality of sine waves can be functionally generated. A sine wave generator may be arranged in accordance with a time division multiplexing.

According to the present invention as described above in detail, a common envelope function is provided for the component wave signals of a plurality of orders. The common envelope function is modified by the envelope modifying means into envelope functions of the respective orders. The envelopes of the component wave signals are controlled in accordance with modified envelope functions. Therefore, the user need not prepare all envelopes for the component wave signals. Much labor can be advantageously reduced to produce musical tones.

Furthermore, the global envelope setting means is arranged to give at least one global envelope function. The plurality of component waves to be produced by the component wave generating means are divided into at least the first and second groups. The envelope functions for controlling the component waves of the respective orders belonging to the first group are obtained by modifying the global envelope function by the first envelope modifying means, and the envelope functions for controlling the component waves of the respective orders belonging to the second group are obtained by modifying another global envelope function by the second envelope modifying means. Therefore, the user need set only a limited number of envelopes, thus improving operability for producing musical tones. In addition, since the envelope functions for controlling the component waves of the first group can be independent of the envelope functions for controlling the component waves of the second group, musical tone with high-quality musical tones can be produced.

The present invention is exemplified by the particular embodiment described above in detail. However, the present invention is not limited to these embodiments, and various changes and modifications may be made within the spirit and scope of the invention.

What is claimed is:

1. A musical tone generating apparatus for synthesizing a musical tone signal by combining a plurality of component wave signals, comprising:

Component wave generating means for generating a plurality of component wave signals;

common envelope setting means for supplying a single common envelope function for all of said plurality of component wave signals;

envelope modifying means for modifying said single common envelope function supplied from said common envelope setting means into respective envelope functions; and envelope controlling means for controlling envelopes of said plurality of component wave signals in accordance with said respective envelope functions.

2. The apparatus of claim 1, further comprising user controllable means coupled to said common envelope setting means for enabling a user to vary said single common envelope function.

3. The apparatus of claim 1, wherein said envelope modifying means includes means for generating said respective envelope functions having values amplified in accordance with a closeness between a value of said single common envelope function and values of harmonic orders in a range where respective values of the harmonic orders are substantially the same as a value of said single common envelope function.

4. The apparatus of claim 1, wherein said envelope modifying means includes means for generating said respective envelope functions having values attenuated in accordance with differences between a value of said single common envelope function and values of harmonic orders in a range where respective values of are higher than the value of said single common envelope function.

5. The apparatus of claim 1, wherein said envelope modifying means includes means for generating said respective envelope functions having values attenuated in accordance with differences between a value of said single common function and values of harmonic orders in a range where respective values of the harmonic orders are lower than the value of said single common envelope function.

6. The apparatus of claim 1, wherein said envelope modifying means includes means for performing a modification expressed by:

$$G(x, W)$$

where W is a value of the single common envelope function, x is a value of harmonic orders, and G(x, W) is a modifying function having values determined in accordance with x and W, thereby generating said respective envelope functions corresponding to the value of the harmonic orders.

7. The apparatus of claim 6, wherein said envelope modifying means includes arithmetic and logic means for performing said modification by the function G(x, W) in accordance with arithmetical or logical operations.

8. The apparatus of to claim 6, wherein said envelope modifying means includes a modification table, and means for performing said modification by the function G(x, W) by accessing said modification table by using x and W as parameters.

9. The apparatus of to claim 6, wherein said envelope modifying means includes means for performing said modification by the function G(x, W) by using as a parameter at least one of $x-W$, $x/W$, $[x \cdot W]$ $x \cdot W$ and $x+W$.

10. The apparatus according to claim 1, wherein said common envelope setting means includes means for supplying said single common envelope function in the form of waveform data, and said envelope modifying means includes means for generating said respective envelope functions of corresponding harmonic orders in the form of waveform data by modifying said single common envelope function.

11. The apparatus according to claim 1, wherein said common envelope setting means includes means for supplying said single common envelope function in the form of polygonal line type data, and said envelope modifying means includes means for generating the respective envelope functions of corresponding harmonic orders in at least one of the form of waveform data and the form of polygonal line type data by modifying the single common envelope function.

12. A musical tone generating apparatus for synthesizing a musical tone signal by combining a plurality of component wave signals, comprising:

first generating means for generating a first group of respective component wave signals;

second generating means for generating a second group of respective component wave signals;

global envelope setting means for supplying at least one type of global envelope function;

first envelope modifying means for modifying the global envelope function from said global envelope setting means, in accordance with the respective component wave signals of said first group, and for generating first envelope functions; and second envelope modifying means for modifying the global envelope function from said global envelope setting means in accordance with the respective component wave signals of said second group, and for generating second envelope functions;

said first generating means being responsive to said first envelope functions for controlling the respective component wave signals belonging to the first group in accordance with the first envelope functions from said first envelope modifying means;

said second generating means being responsive to said second envelope functions for controlling the respective component wave signals belonging to the second group in accordance with the second envelope functions from said second envelope modifying means;

said first envelope functions generated by said first envelope modifying means and said second envelope functions generated by said second envelope modifying means being different from each other.

13. The apparatus of claim 12, wherein said first envelope functions generated by said first envelope modifying means and said second envelope functions generated by said second envelope modifying means are generated independently of each other.

14. The apparatus of claim 12, wherein said first envelope functions correspond to respective harmonic orders of component wave signals of said first group; and said second envelope functions correspond to respective harmonic orders of said component wave signals of said second group.

15. The apparatus of claim 14, wherein said first envelope functions generated by said first envelope modifying means and said second envelope functions generated by said second envelope modifying means are generated independently of each other.

16. The apparatus of claim 12, wherein said global envelope setting means includes means for supplying a first global envelope function W1(t) for causing said first envelope modifying means to generate said first envelope functions, and a second global envelope function W2(t) for causing said second envelope modifying means to generate said second envelope functions; and wherein said second global envelope function W2(t) is different from said first global envelope function W1(t).

17. The apparatus according to claim 12, wherein said global envelope setting means includes means for supplying a single global envelope function W, said first envelope modifying means includes means for generating said first envelope functions by using a value of harmonic order x as a parameter in accordance with a first modification logic algorithm Fx(W), and said second envelope modifying means includes means for generating said second envelope functions by using the value of the harmonic order x as a parameter in accordance with a second modification logic algorithm Gx(W) different from said first modification logic algorithm Fx(W).

18. The apparatus according to claim 12, wherein said global envelope setting means further comprises:

single global envelope function generating means for generating a single global envelope function W;

modifying means for receiving a single global envelope function W supplied from said single global envelope function generating means and for generating a first global envelope function G(W) and a second global envelope function H(W) different from the first global envelope function G(W);

said modifying means including means for supplying said first global envelope function G(W) to said first envelope modifying means and said second global envelope function H(W) to said second envelope modifying means.

* * * * *